US007207836B2

(12) United States Patent
Tsai

(10) Patent No.: US 7,207,836 B2
(45) Date of Patent: Apr. 24, 2007

(54) ELECTRICAL CONNECTOR HAVING AN ENGAGING ELEMENT AND A METAL HOUSING THAT PERTAIN TO DIFFERENT PARTS

(76) Inventor: Chou Hsuan Tsai, 15F,No. 4, Lane 127, Sec. 1, Fu-Hsing Rd., Hsin-Chuang City, Taipei Hsien (TW)

( * ) Notice: Subject to any disclaimer, the term of this patent is extended or adjusted under 35 U.S.C. 154(b) by 0 days.

(21) Appl. No.: 11/355,774

(22) Filed: Feb. 15, 2006

(65) Prior Publication Data

US 2006/0183380 A1 Aug. 17, 2006

(51) Int. Cl.
*H01R 13/60* (2006.01)

(52) U.S. Cl. ..... 439/541.5; 439/607

(58) Field of Classification Search ..... 439/540.1, 439/541.5, 607

See application file for complete search history.

(56) References Cited

U.S. PATENT DOCUMENTS 5,797,770 A * 8/1998 Davis et al. ..... 439/607
6,027,375 A * 2/2000 Wu ..... 439/607
6,273,757 B1 * 8/2001 David et al. ..... 439/607
6,902,432 B2 * 6/2005 Morikawa et al. ..... 439/607
6,939,168 B2 * 9/2005 Oleynick et al. ..... 439/541.5
7,052,321 B2 * 5/2006 Chang ..... 439/607

* cited by examiner

*Primary Examiner*—Thanh-Tam Le
(74) *Attorney, Agent, or Firm*—Pro-Techtor Int'l Services

(57) ABSTRACT

An electrical connector to be electrically connected to a plug includes a plastic base, a metal housing and an engaging element. A connection slot and terminals are formed on the base. Each terminal has a pin portion extending out of the plastic base. The metal housing covers the plastic base while exposing the connection slot and the pin portions. The engaging element has a fixing part and an elastic engaging piece which is located within the connection slot. A projecting engaging portion, which is near a distal end of the engaging element and engages with the plug, is formed. The metal housing is composed of a thin metal plate which is bent. The engaging element and the metal housing pertain to different parts. A thickness of the engaging element is greater than that of the metal housing. The engaging element is assembled in the plastic base through the fixing part.

13 Claims, 19 Drawing Sheets

ELECTRICAL CONNECTOR HAVING AN ENGAGING ELEMENT AND A METAL HOUSING THAT PERTAIN TO DIFFERENT PARTS

BACKGROUND OF THE INVENTION

1. Field of the Invention

The invention relates to an electrical connector, and more particularly to an electrical connector having a metal housing.

2. Description of the Related Art

Referring to FIGS. 1 and 2, a dual-layer USB (Universal Serial Bus) electrical connector into which a convention USB plug is inserted includes a plastic base 10, a metal housing 20 and a front fitting part 30. The plastic base 10 has a baffle 11 and two connection slots 12 at a front end thereof. A plurality of terminals 13 is disposed in the plastic base 10. The metal housing 20 covers the plastic base 10 and enables the connection slots 12 of the plastic base and a pin portion of each terminal 13 to be exposed to the outside. The metal housing 20 has top and bottom surfaces each formed with two elastic engaging pieces 21 by way of pressing. The elastic engaging piece 21 is formed with a projecting engaging portion 22 at a portion near a distal end thereof, two elastic grounding pieces 23 at two side plates thereof by way of pressing, fastening hooks 24 at two sides of the bottom end thereof, and engagement holes 25 at two sides of the front end thereof. The front fitting part 30 has a ⊏-shaped cross-sectional area and is formed with two elastic engaging pieces 31 at two surfaces thereof. The elastic engaging piece 31 is formed with a projecting engaging portion 32 at a portion near a distal end thereof and hooks 33 at two sides thereof. The baffle 11 of the plastic base 10 is fit into the front fitting part 30, and the hooks 33 hook the engagement holes 25 of the metal housing 20.

According to the above-mentioned structure, when the USB plug 35 is inserted into the connection slot 12, the engaging portions 22 of the two elastic engaging piece 21 of the metal housing 20 and the two engaging portions 32 of the two elastic engaging pieces 31 of the front fitting part 30 engage with the engagement holes 36 formed at the two surfaces of the USB plug 35.

The prior art structure has the following drawbacks.

1. Each of the top and bottom surfaces of the metal housing 20 is pressed to form two elastic engaging pieces 21 for engaging with the engagement holes 36 of the USB plug 35, and the lower edges of the metal housing 20 are integrally extended to form the fastening hooks 24. So, the plastic engaging pieces 21 and the fastening hooks 24 must have the proper intensity in order to achieve the stable engaging and hooking effects. In this way, the metal housing 20 cannot be formed by a thinner plate, or the elastic engaging piece 21 and the fastening hook 24 may have insufficient intensity and elasticity, and the effect of saving the material cannot be achieved.

2. Because the fastening hooks 24 are integrally formed at the lower edges at two sides of the metal housing 20 by way of pressing, the two side plates have to be long enough such that the fastening hooks 24 can be formed, and the material is thus wasted.

3. Because the fastening hooks 24 are integrally formed at the lower edges at two sides of the metal housing 20, tin has to be plated on the fastening hooks 24 such that the fastening hooks 24 may be electrically connected to the circuit board. Thus, the plating cost has to be added.

4. As shown in FIG. 3, when the USB plug 35 is pulled out and thus pushes the elastic engaging pieces 21 and 31, the elastic engaging pieces 21 and 31 elastically move according to the elasticity thereof, and the baffle 11 is not pressed. The engaging intensity completely comes from the intensity thereof, so each of the elastic engaging pieces 21 and 31 must have the sufficient thickness to provide the sufficient engaging force.

SUMMARY OF THE INVENTION

It is therefore an object of the invention to provide an electrical connector having an engaging element and a metal housing that pertain to different parts such that the manufacturing cost is reduced.

Another object of the invention is to provide an electrical connector having an engaging element and a metal housing that pertain to different parts, wherein the engaging element is assembled and positioned from the backside of the plastic base such that the good positioning effect of the engaging element may be obtained.

Still another object of the invention is to provide an electrical connector having an engaging element, which has an elastic engaging piece that can be elastically moved to press a plastic base of the electrical connector such that the force for engaging the transmission cable plug can be maximized.

Yet still another object of the invention is to provide an electrical connector having an engaging element and a fastening assembly that are separated from a metal housing before the connector is assembled and are fixed onto the plastic base in a good positioning manner. Thus, the metal housing may be made of the ultra-thin metal plate because it does not have to withstand the engaging force and the fastening force.

Yet still another object of the invention is to provide an electrical connector having a fastening assembly and a metal housing that pertain to different parts such that the manufacturing cost is reduced.

To achieve the above-identified objects, the invention provides an electrical connector to be electrically connected to a transmission cable plug. The connector includes a plastic base, a metal housing and at least one engaging element. At least one connection slot and a plurality of terminals are formed on the plastic base. Each of the terminals has a pin portion extending out of the plastic base. The metal housing covers the plastic base while exposing the at least one connection slot of the plastic base and the pin portion of each of the terminals. The at least one engaging element has a fixing part and at least one elastic engaging piece which is located within the at least one connection slot of the plastic base. A projecting engaging portion, which is near a distal end of the at least one engaging element and engages with the transmission cable plug, is formed. The metal housing is composed of a thin metal plate which is bent. The at least one engaging element and the metal housing pertain to different parts. A thickness of the at least one engaging element is greater than that of the metal housing. The at least one engaging element is assembled in the plastic base through the fixing part. Thus, a large-area metal housing may be made of an ultra-thin metal plate, and the manufacturing cost is reduced greatly. The engaging element and the grounding element may be made of a thicker metal plate or other suitable materials such that the sufficient elasticity and rigidity can be obtained.

Other objects, features, and advantages of the invention will become apparent from the following detailed description of the preferred but non-limiting embodiments. The following description is made with reference to the accompanying drawings.

DETAILED DESCRIPTION OF THE INVENTION

Figures 1, 2:
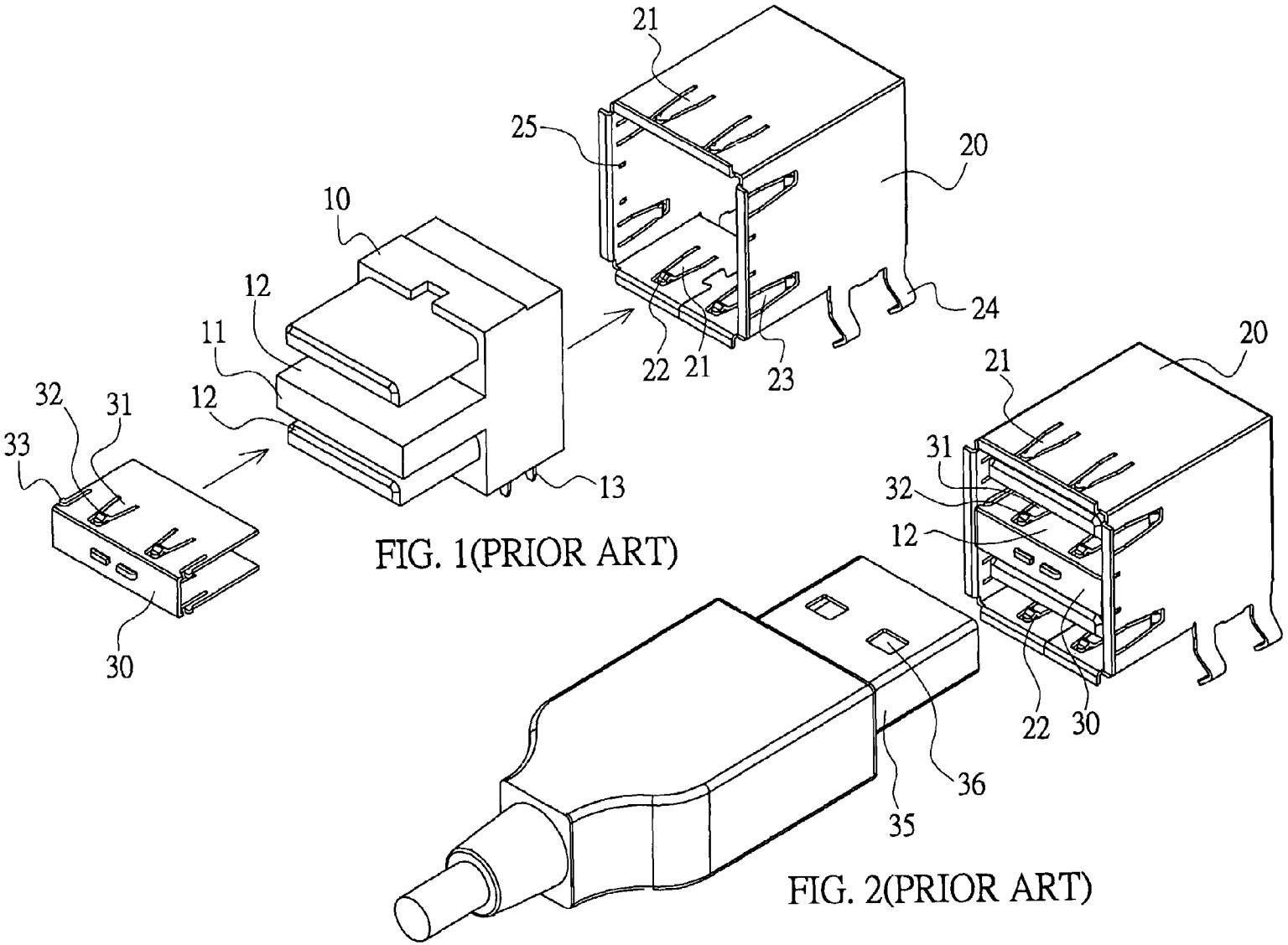
FIG. 1(PRIOR ART)
FIG. 2(PRIOR ART)
FIG. 1 is a pictorially exploded view showing a conventional electrical connector.
FIG. 2 is a pictorially assembled view showing the conventional electrical connector.
Figure 3:
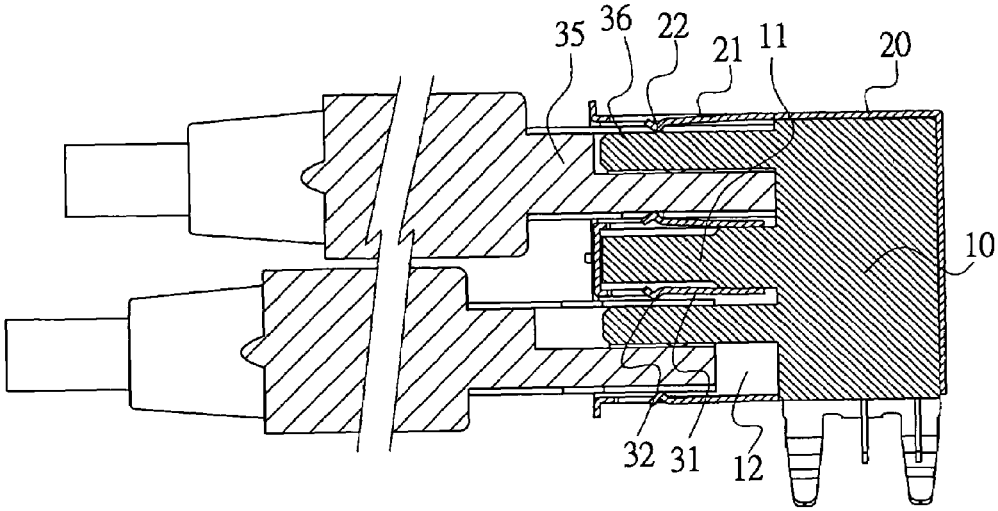
FIG. 3(PRIOR ART)
FIG. 3 is a cross-sectional side view showing a usage state of the conventional electrical connector.
Figure 5:
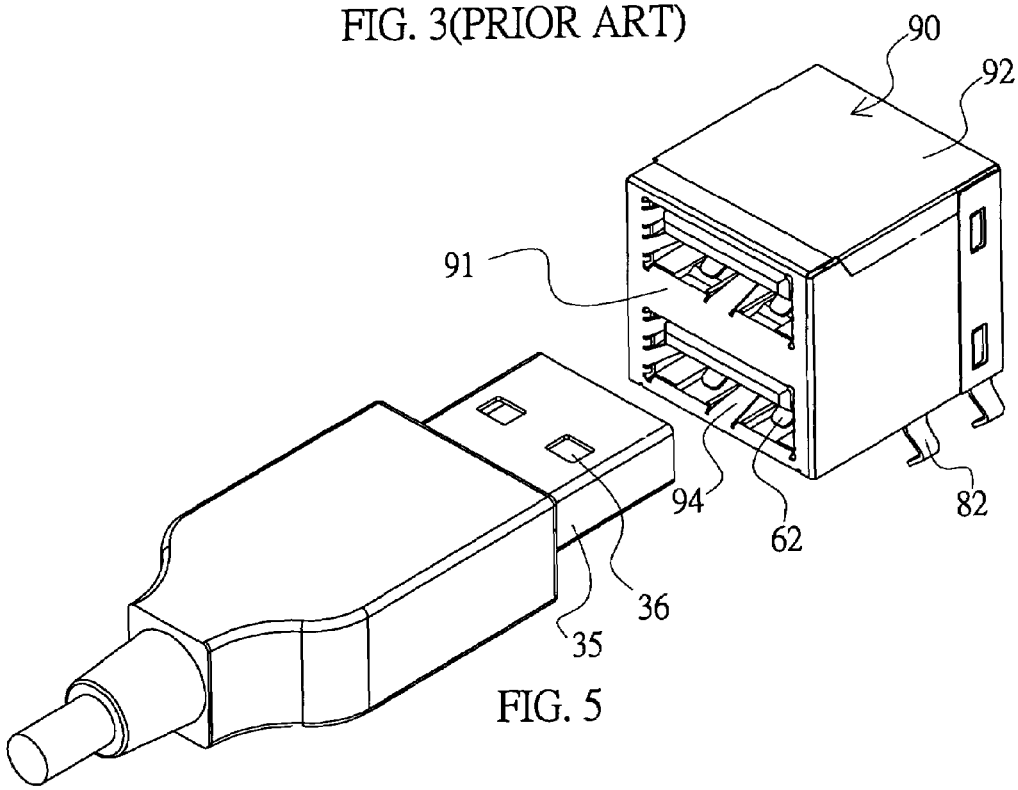
FIG. 5 is a pictorially assembled view showing the electrical connector according to the first embodiment of the invention.
Figure 4:
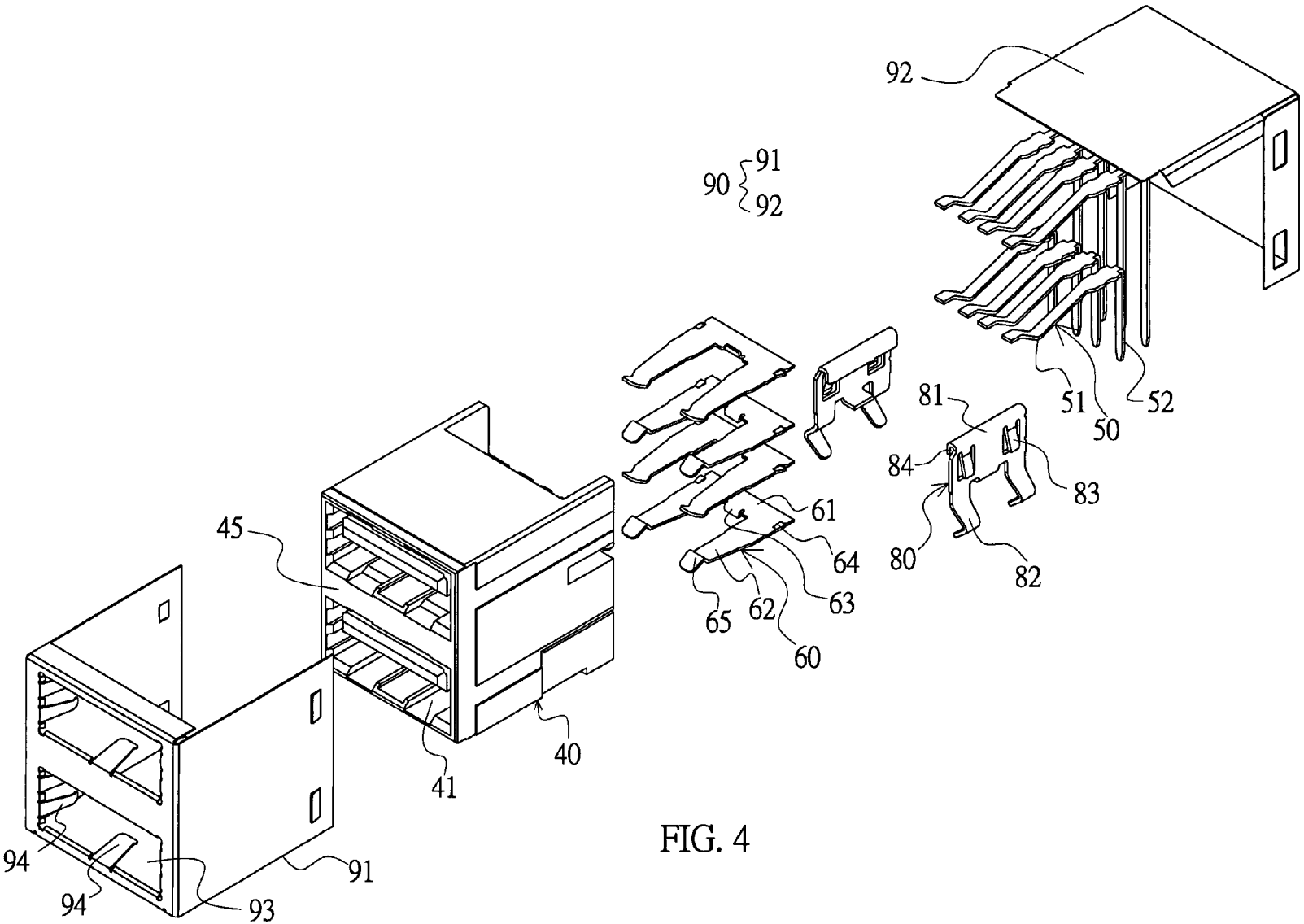
FIG. 4 is a pictorially exploded view showing an electrical connector according to a first embodiment of the invention.
Figure 6:
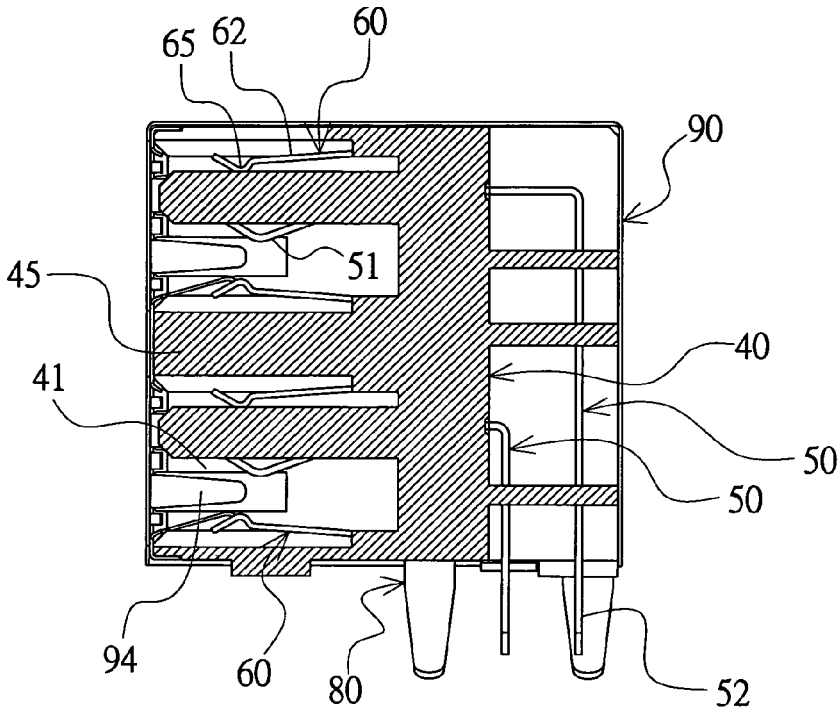
FIG. 6 is a cross-sectional, assembled view showing the electrical connector according to the first embodiment of the invention.

Referring to FIGS. 4 to 6, a dual-layer USB electrical connector according to a first embodiment of the invention is to be electrically connected to a USB plug 35 having at least one engagement hole 36. The dual-layer USB electrical connector includes a plastic base 40, four engaging elements 60, two fastening assemblies 80 and one metal housing 90.

Figure 7:
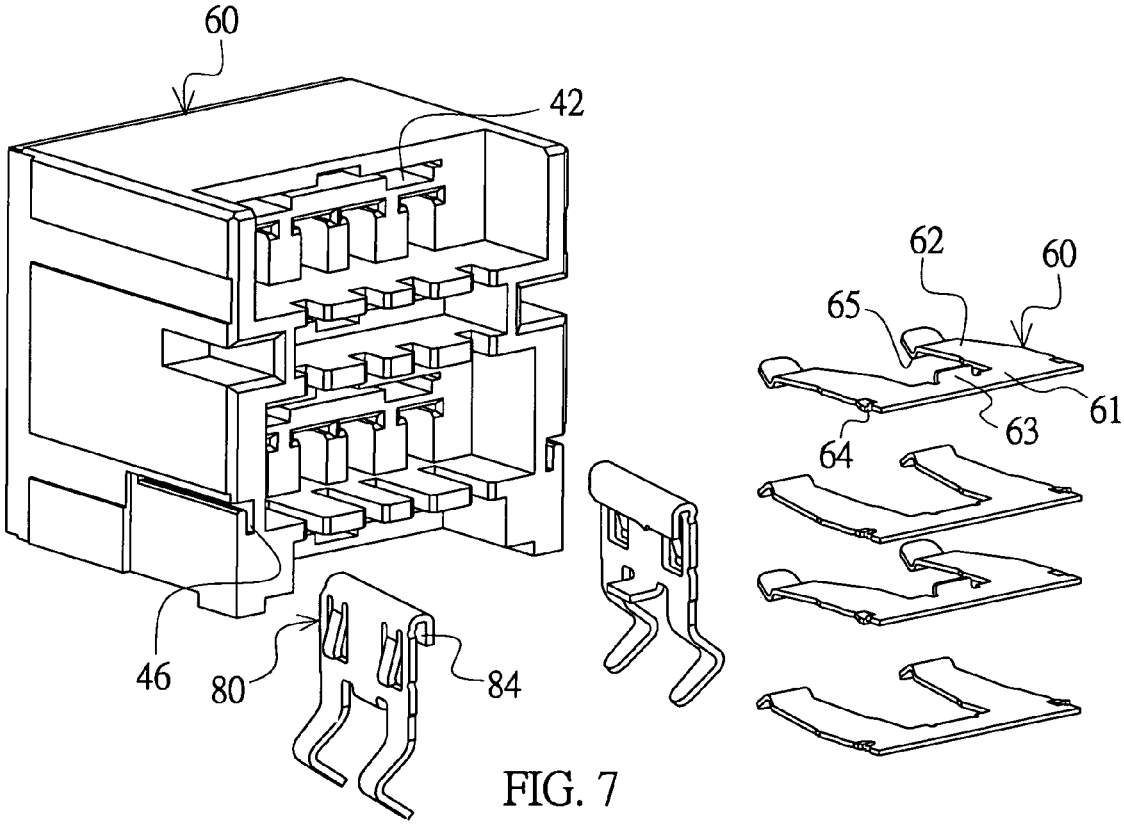
FIG. 7 is a pictorially exploded view showing a plastic base, a fastening assembly and an engaging element of the electrical connector according to the first embodiment of the invention.
Figure 8:
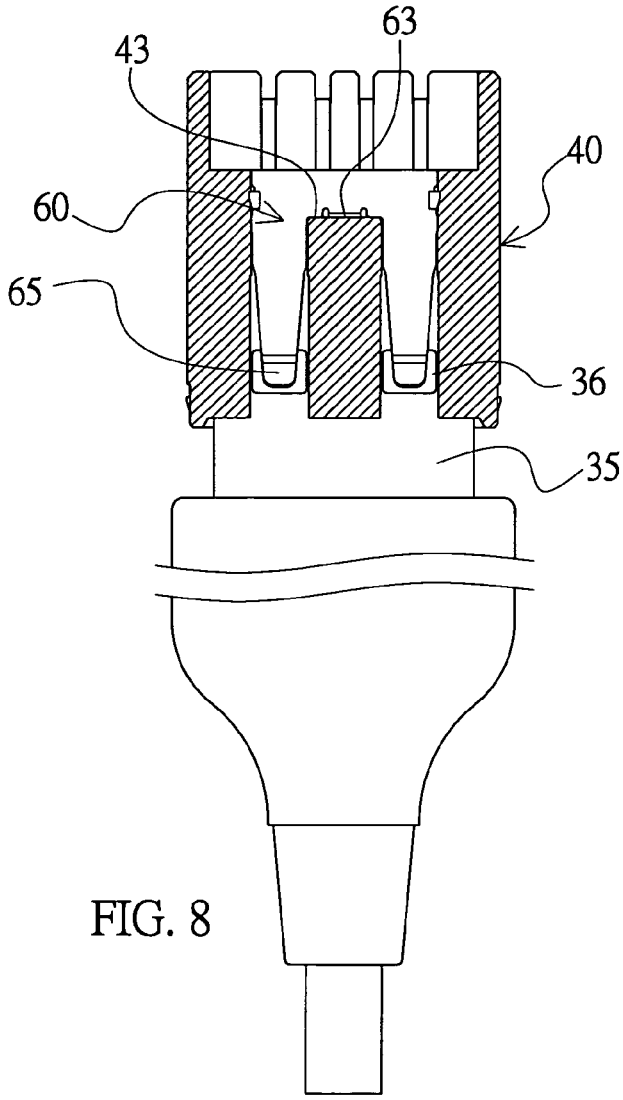
FIG. 8 is a cross-sectional top view showing a usage state of the electrical connector according to the first embodiment of the invention.

At least two connection slots 41 and a plurality of terminals 50 are disposed within the plastic base 40. The front end of the connection slot 41 is an inserting port into which the USB plug 35 may be inserted. As shown in FIGS. 7 and 8, the rear end of each connection slot 41 is formed with two positioning slots 42 and one stopping surface 43. A baffle 45 is disposed or formed between two connection slots 41. In addition, each of the two sides of the rear end of the plastic base 40 is formed with an inverse-L-shaped slot 46 extending from back to front. Each terminal 50 has a contact 51 located at the connection slot 41 and a pin portion 52 extending to a bottom of the plastic base 40.

The engaging element 60 and the metal housing 90 pertain to different parts. The plate-like engaging element 60 having an inverse-U shape has a fixing part 61 and two elastic engaging pieces 62. The front end of the middle of the fixing part 61 is formed with a stopping portion 63. Each of the two sides of the fixing part 61 is formed with a projection 64. Each engaging element 60 is assembled and fixed to the plastic base 40 in a direction from a connection slot 41 at the rear end of the plastic base 40 to the positioning slot 42. The stopping surface 43 of the plastic base 40 stops the stopping portion 63 of the fixing part 61 of the engaging element 60. The elastic engaging piece 62 is located within the connection slot 41 of the plastic base 40. A projecting engaging portion 65 for engaging with the engagement hole 36 of the USB plug is formed near a distal end of the elastic engaging piece 62.

Each fastening assembly 80 has a fixing part 81 and two elastic hooks 82. A top of the fixing part 81 is formed with a hook 84 for hooking the slot 46 at each of the two sides of the plastic base 40. The two elastic hooks 82 protrude over the bottom of the plastic base 40. The fixing part 81 is pressed to form two elastic sheets 83.

The metal housing 90 is formed by bending a stainless steel plate (or thin metal plate) having a thickness of 0.1 mm. The metal housing 90 includes a front housing 91 and a rear housing 92 that can be assembled together. The front housing 91 has a front plate and two side plates. The rear housing 92 having a top plate and a rear plate covering the plastic base 40 and elastically contacts the elastic sheet 83 of the fastening assembly 80. The bottom of the rear housing 92 is open and the front housing 91 has two openings 93 and a plurality of elastic grounding pieces 94, each of which is connected to a circumference of the opening 93. The open bottom and the two openings 93 expose the two connection slot 41 of the plastic base and the pin portion 52 of each terminal 50 to the outside.

Each of the engaging element 60 and the fastening assembly 80 is made of a stainless steel plate (thick metal plate) with the thickness of 0.3 mm such that the sufficient intensity and elasticity can be obtained. The large-area metal housing 90 is formed by bending a stainless steel plate (thin metal plate) with the thickness of 0.1 mm, and the material cost can be greatly reduced.

Figure 9:
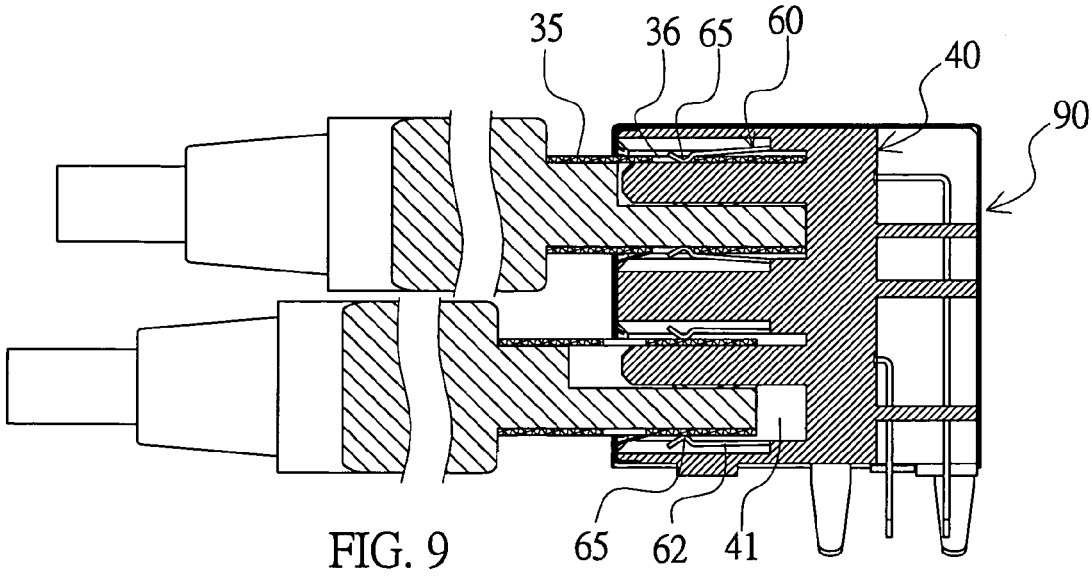
FIG. 9 is a cross-sectional side view showing a usage state of the electrical connector according to the first embodiment of the invention.

According to the above-mentioned structure, as shown in FIG. 9, when the USB plug 35 is inserted into the connection slot 41, the upper and lower engagement holes 36 may be engaged by the engaging portions 65 of the engaging element 60. As shown in FIG. 8, the stopping portion 63 of the fixing part of the engaging element 60 may be blocked by the stopping surface 43 of the plastic base 40, so the engaging element 60 cannot escape from the plastic base 40 in a pulling out direction for the connection slot 41. Thus, when the USB plug 35 is pulled by a force, the USB plug 35 still can be firmly combined with the plastic base 40. It is to be noted that the metal housing 90 never engages with the engagement hole 36 of the USB plug 35 when the USB plug 35 is inserted from an outermost position of the at least one connection slot 41 to an innermost position of the at least one connection slot 41.

Figure 10:
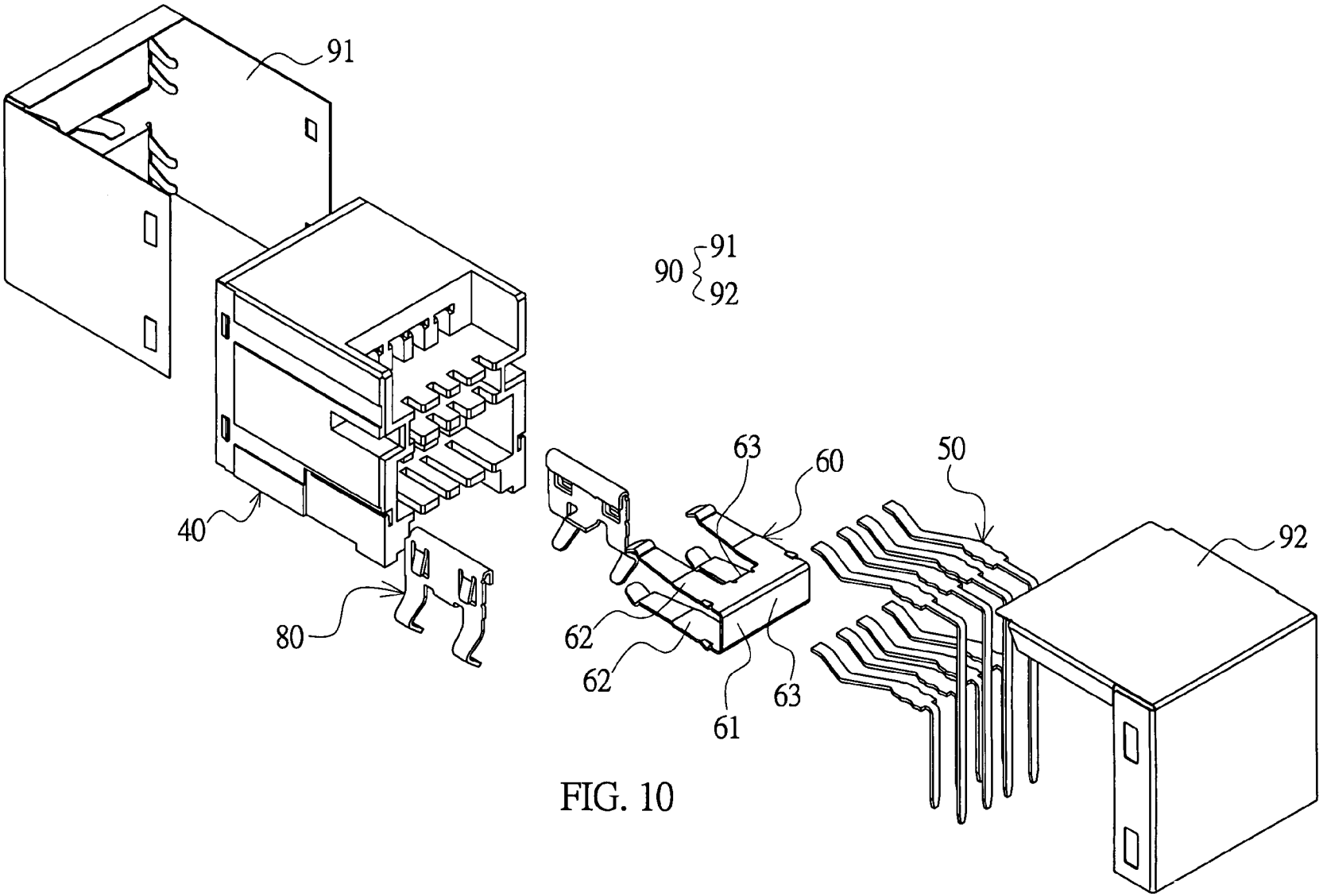
FIG. 10 is a pictorially exploded view showing an electrical connector according to a second embodiment of the invention
Figure 11:
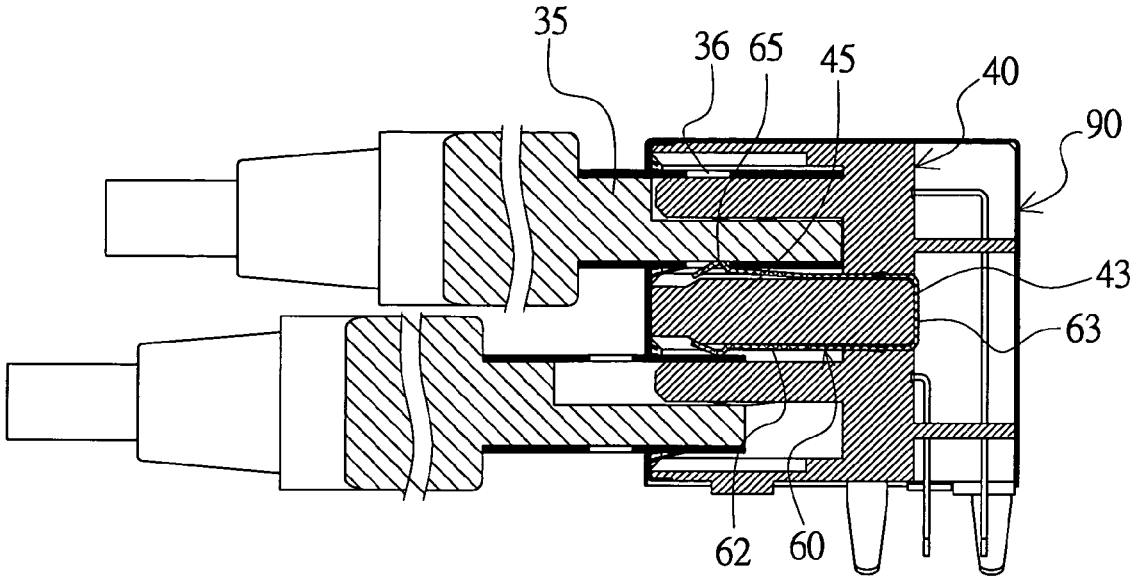
FIG. 11 is a cross-sectional side view showing a usage state of the electrical connector according to the second embodiment of the invention.

As shown in FIGS. 10 and 11, the second embodiment of the invention is almost the same as the first embodiment except that the second embodiment only has one engaging element 60, which has a fixing part 61 having a ⊏-shaped cross-sectional area. Each of the upper and lower surfaces of the engaging element 60 is formed with two elastic engaging pieces 62. The middle of the front end of the fixing part 61 and the middle plate of the engaging element 60 form a stopping portion 63. The elastic engaging pieces 62 at two surfaces of the fixing part 61 are located at two surfaces of the baffle 45 of the plastic base 40. The elastic engaging piece 62 pressed by the USB plug 35 presses the baffle 45. In this embodiment, only one engaging portion 65 of the elastic engaging piece 62 engages with the engagement hole 36 of the USB plug 35. However, when the USB plug 35 is pulled by a force to press the elastic engaging piece 62, the elastic engaging piece 62 presses the baffle 45 and thus enhances the intensity thereof. So, the force for locking the USB plug 35 may be larger, and the single-side engagement can provide the sufficient engaging force.

Figure 12:
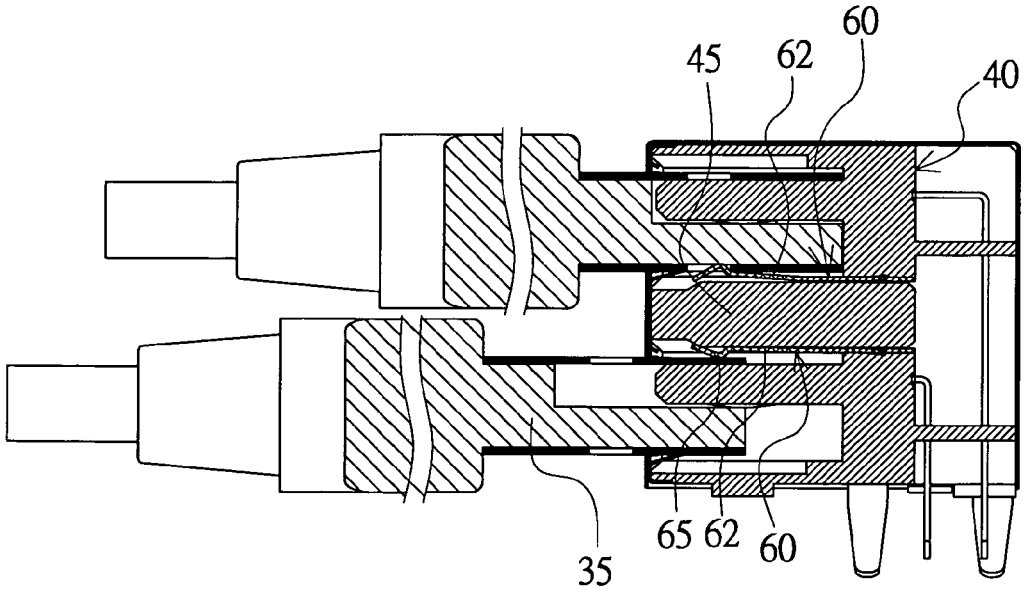
FIG. 12 is a cross-sectional side view showing a usage state of an electrical connector according to a third embodiment of the invention.

As shown in FIG. 12, the third embodiment of the invention is almost the same as the first embodiment except that only two engaging elements 60 are provided. The elastic engaging pieces 62 of the engaging elements 60 are respectively located at two surfaces of the baffle 45 of the plastic base 40. The elastic engaging piece 62 pressed by the USB plug 35 presses the baffle 45.

According to the structures of the invention, the invention has the following advantages.

1. The engaging element 60, the fastening assembly 80 and the metal housing 90 pertain to different parts. So, the engaging element 60 and the fastening assembly 80 may be formed by the minimum metal material with the suitable rigidity or elasticity, and then combined with the plastic base 40 and the low-cost metal housing. Thus, it is unnecessary to form the metal housing, the engaging element 60 and the fastening assembly 80 integrally by way of pressing in order to satisfy the local rigidity or elasticity of the engaging element 60 and the fastening assembly 80, and the material and the manufacturing cost can be reduced. Thus, the metal housing 90 with the larger volume can be made of an ultra-thin stainless steel plate, and the manufacturing cost may be greatly reduced.

2. The fastening assembly 80 and the metal housing 90 pertain to different parts, so the metal housing 90 does not have to be formed by pressing at the bottom end, and the length of the used metal plate and thus the material can be reduced.

3. The fastening assembly 80 and the metal housing 90 pertain to different parts, so the small-area fastening assembly 80 can be individually plated with tin in a simpler manner than the overall metal housing 90, and the plating cost can be reduced.

4. The large-area metal housing 90 may be made of the stainless steel plate with the ultra-small thickness of 0.1 mm and with a cheap manufacturing cost without losing the suitable rigidity and without the plating or anode treating process. Although the engaging element 60 and the fastening assembly 80 are made of the stainless steel plate with the thickness of 0.3 mm, the areas thereof are small and the costs thereof are low.

5. The engaging element 60 is assembled and positioned in a direction from the positioning slot 42 at the rear end of the plastic base 40 to the connection slot 41. Thus, the stopping surface 43 of the plastic base 40 can be stopped by the stopping portion 63 of the fixing part 61 of the engaging element 60 such that the engaging element 60 can be positioned firmly and is free from escaping in a pulling out direction for the connection slot.

6. The elastic engaging piece 62 of the engaging element may be moved elastically to press the baffle 45. So, when the USB plug 35 is to be pulled out to press the elastic engaging piece 62, the elastic engaging piece 62 presses the baffle 45 and the intensity thereof is enhanced. So, the force of engaging the USB plug 35 may be larger.

7. Both the engaging element 60 and the fastening assembly 80 and the metal housing 90 are disposed separately before the connector is assembled, the engaging element 60 and the fastening assembly 80 are assembled and fixed onto the plastic base 40 to obtain the good positioning effect, and the metal housing 90 only has the function of shielding without withstanding the engaging force and the fastening force. So, the metal housing 90 may be made of the ultra-thin metal plate.

According to the description stated hereinabove, the technological feature of the invention, in which the metal housing and the engaging element and the fastening assembly are manufactured separately and then assembled with the plastic base, is completely different from the conventional feature, in which the metal housing is integrally pressed to form the elastic engaging piece and the fastening assembly.

The prior art has wasted a lot of resources on the earth and increased the cost in order to integrally form the housing, the engaging element and the fastening assembly by way of pressing. However, different elements with different functions can be formed by different materials, and the manufacturing cost and the resource on the earth can be reduced. Thus, the invention indeed enhances the product effect, reduces the manufacturing cost, and enhances the utility in the industry.

Figure 13:
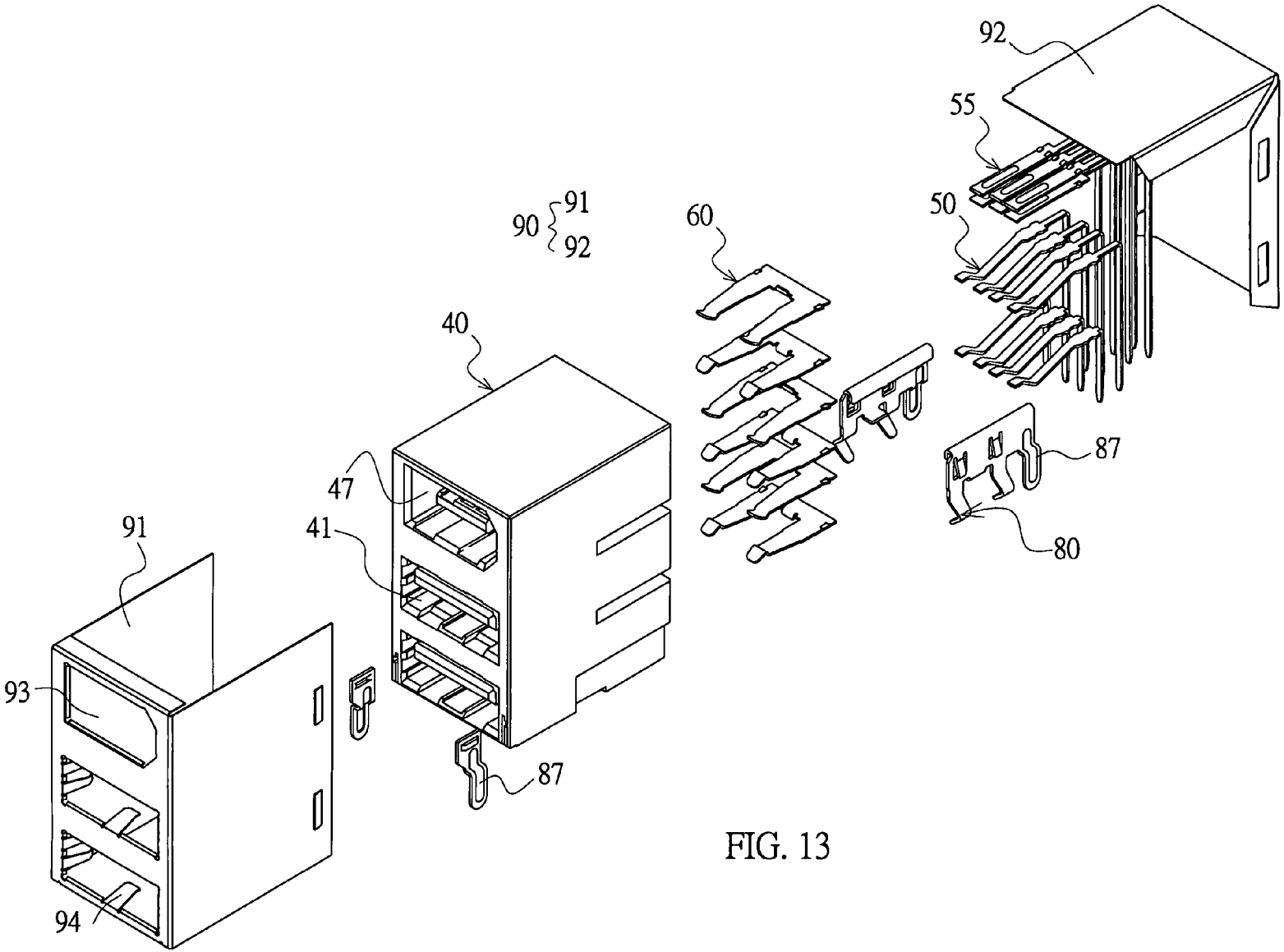
FIG. 13 is a pictorially exploded view showing an electrical connector according to a fourth embodiment of the invention.
Figure 14:
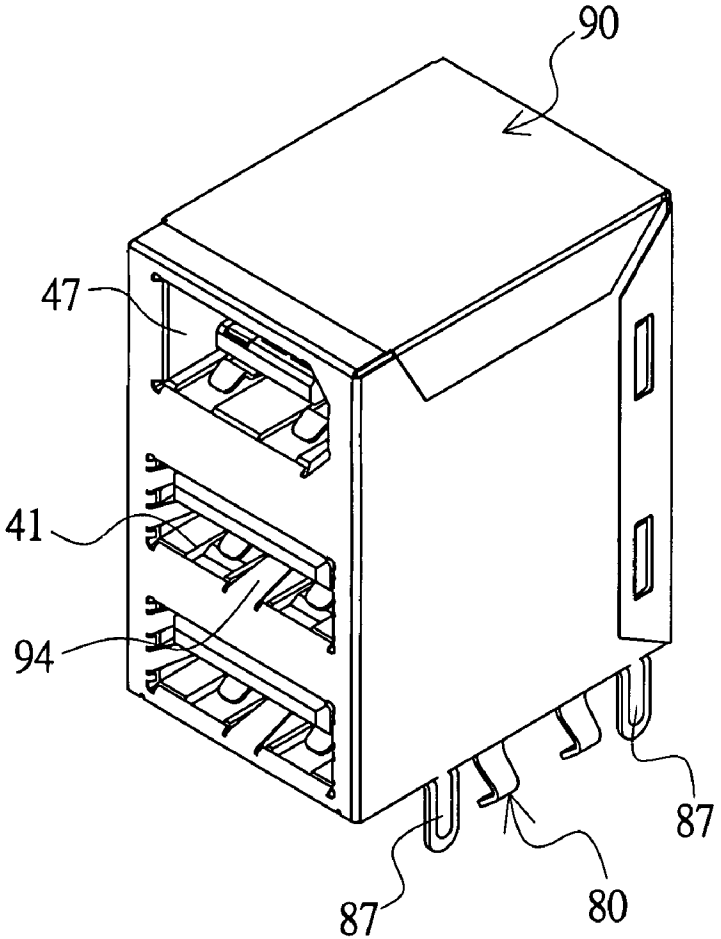
FIG. 14 is a pictorially assembled view showing the electrical connector according to the fourth embodiment of the invention.

As shown in FIGS. 13 and 14, the fourth embodiment of the invention is almost the same as the first embodiment except that the connector of the fourth embodiment is a combination of a dual-layer USB socket and an express serial bus (e.g., IEEE1394) socket. That is, the connector includes a plastic base 40 formed with two connection slots 41, which are the same, and one connection slot 47 different from the connection slot 41. The metal housing 90 is formed with three openings 93 corresponding to the three connection slots and a plurality of elastic grounding pieces 94. The terminals 50 and the engaging elements 60 are disposed in the lower two connection slots 41 to be connected to the USB plug. The terminals 55 and the engaging elements 60 to be connected to the IEEE1394 plug are disposed in the upper connection slot 47. In addition, a positioning sheet 87 is attached to each of the four corners at the lower end of the plastic base 40. The positioning sheet 87 at the rear end and the fastening assembly 80 are integrally formed.

Figure 15:
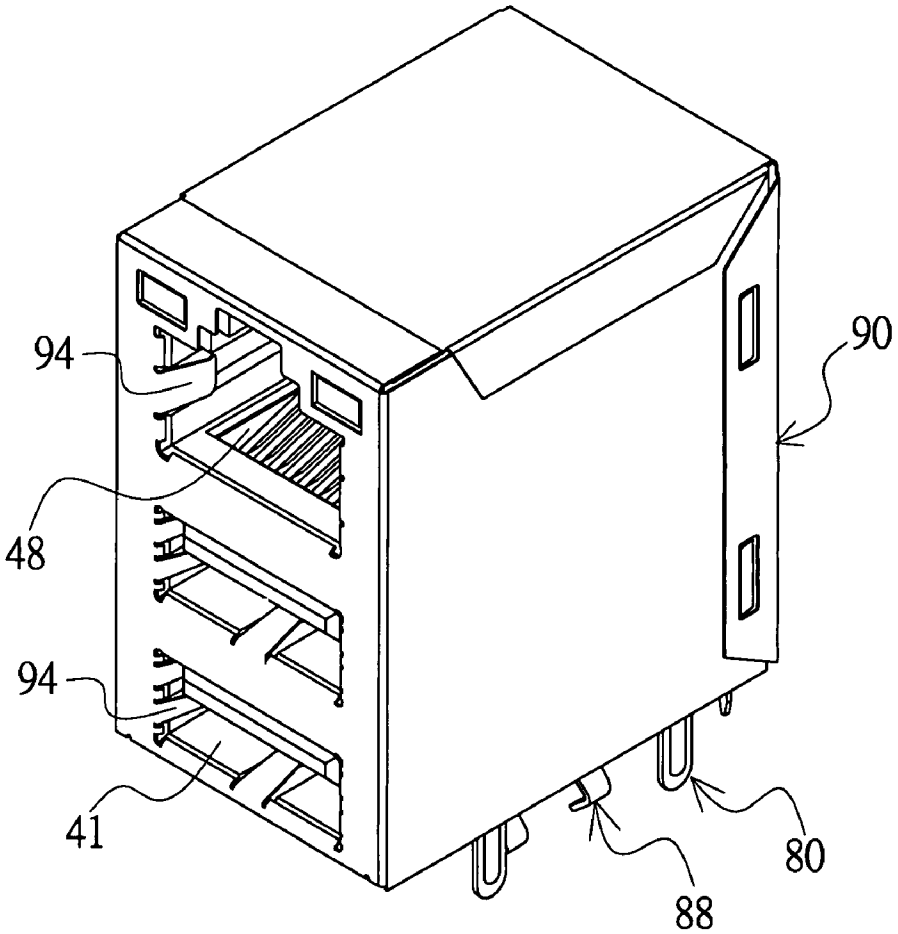
FIG. 15 is a pictorially assembled view showing an electrical connector according to a fifth embodiment of the invention.
Figure 16:
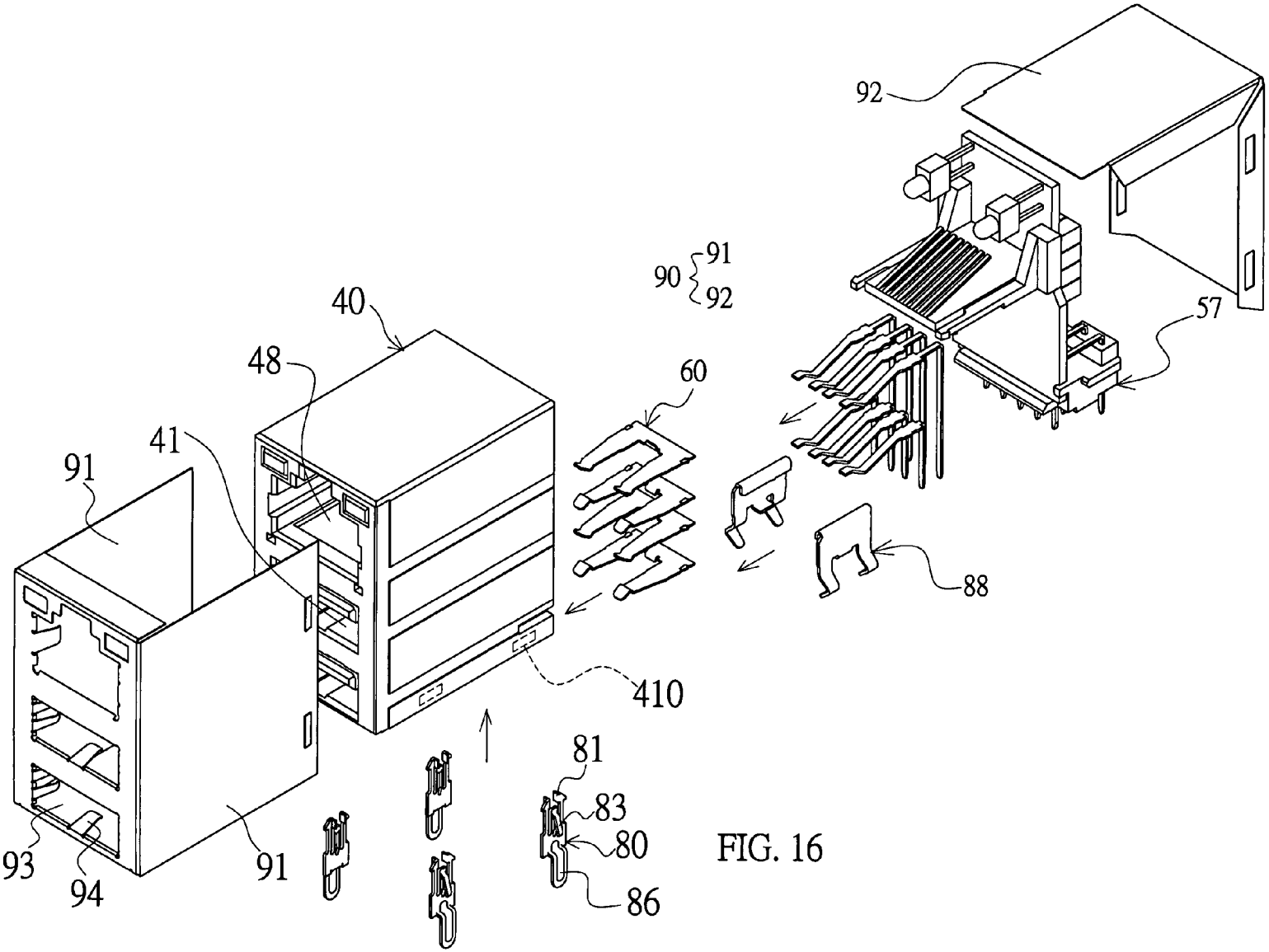
FIG. 16 is a pictorially exploded view showing the electrical connector according to the fifth embodiment of the invention.

As shown in FIGS. 15 and 16, the fifth embodiment of the invention is almost the same as the first embodiment except that the connector of the fifth embodiment is a combination of a dual-layer USB socket and a network transmission (RJ45) socket. That is, the plastic base 40 has two connection slots 41, which are the same, and one connection slot 48 different from the slot 41. The metal housing 90 is formed with three openings 93 corresponding to the three connection slots and a plurality of elastic grounding pieces 94. The terminals 50 and the engaging elements 60 are disposed in the lower two connection slots 41 to be connected to the USB plugs. An RJ45 terminal set 57 is disposed in the upper connection slot 48 to be connected to the RJ45 plug. In addition, this embodiment has four fastening assemblies 80 and two hooking elements 88. The fastening assembly 80 has a fixing part 81, an elastic sheet 83 and an inserting sheet 86. The fixing part 81 has two symmetrical, elastic inverse hooks 82, which are inserted, from top to bottom, into slots 410 formed on the bottom surface of the plastic base 40. The elastic sheet 83 elastically contacts the metal housing 90. The inserting sheet 86 may be inserted into a hole of a circuit board and is then bonded to form the electrical connection. The two hooking elements 88 engage with the plastic base 40 and function to hook the circuit board.

Figures 17, 18:
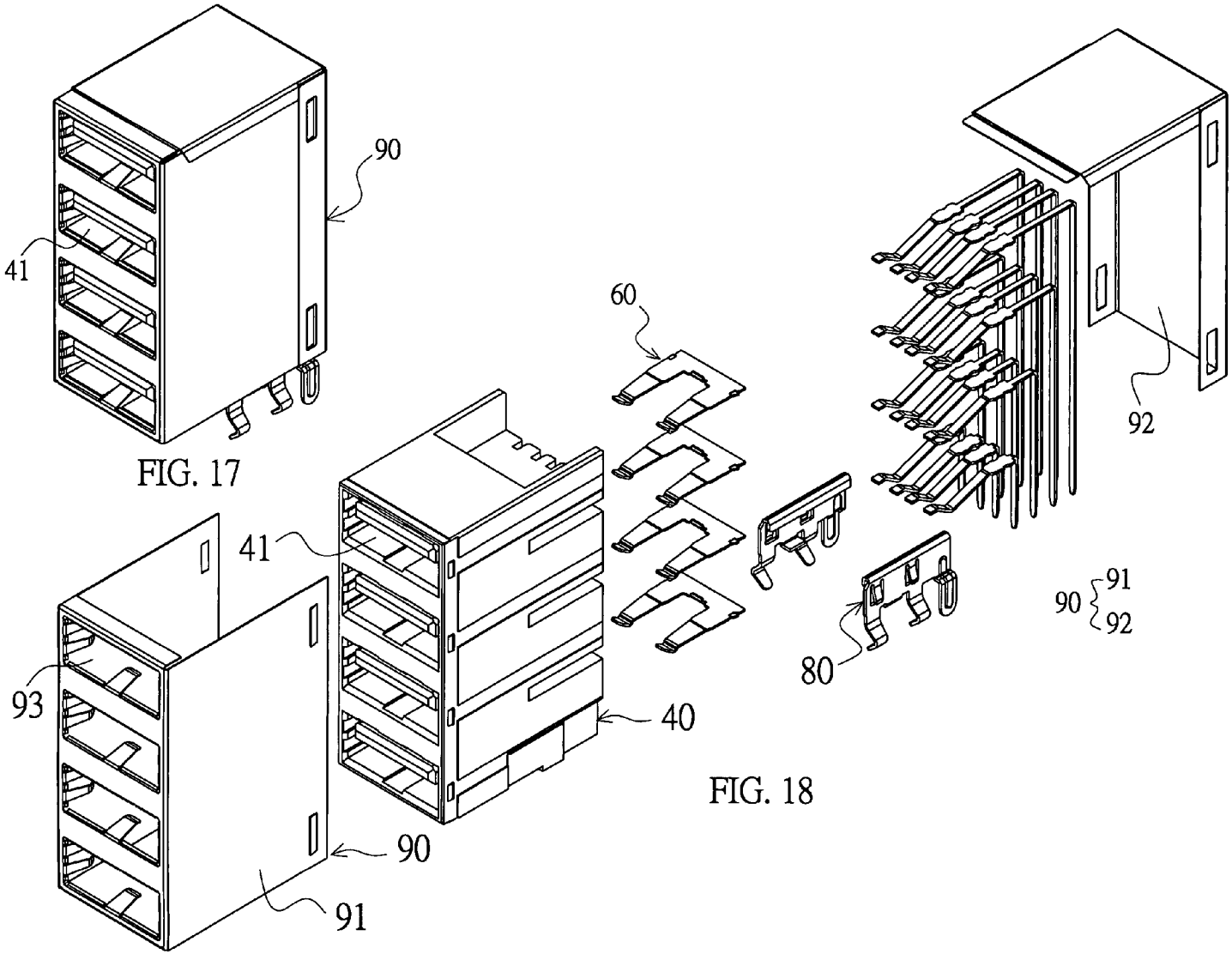
FIG. 17 is a pictorially assembled view showing an electrical connector according to a sixth embodiment of the invention.
FIG. 18 is a pictorially exploded view showing the electrical connector according to the sixth embodiment of the invention.

As shown in FIGS. 17 and 18, the sixth embodiment of the invention is almost the same as the first embodiment except that the sixth embodiment has four layers of USB sockets. The plastic base 40 has four connection slots 41, which are the same and to be connected to the USB plugs. The metal housing 90 is formed with four openings 93 corresponding to the four connection slots 41.

Figure 19:
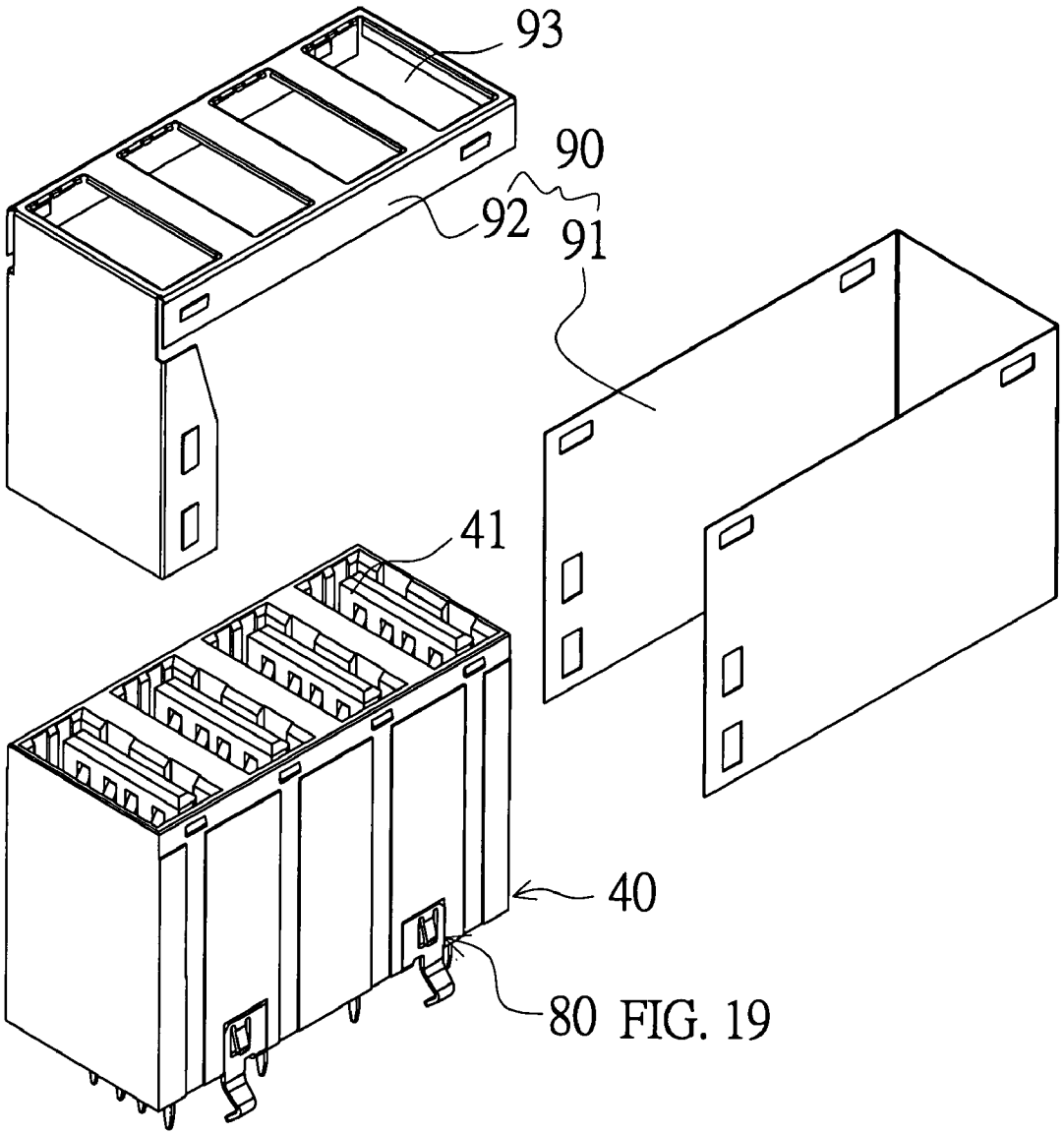
FIG. 19 is a pictorially assembled view showing an electrical connector according to a seventh embodiment of the invention.
Figure 20:
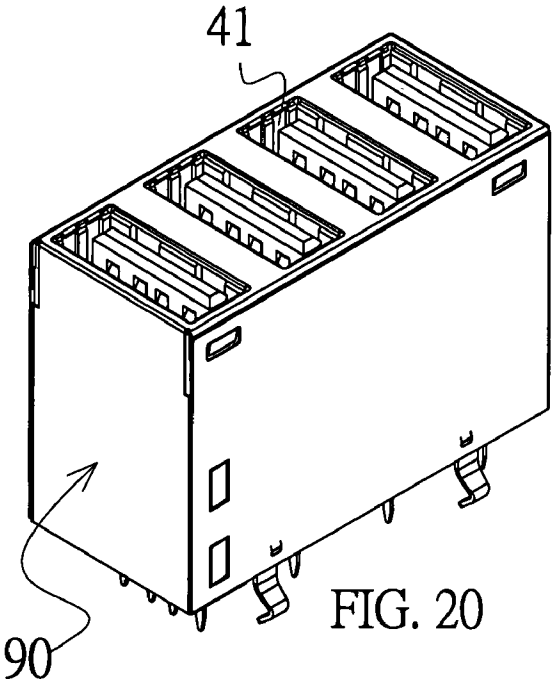
FIG. 20 is a pictorially exploded view showing the electrical connector according to the seventh embodiment of the invention.

As shown in FIGS. 19 and 20, the seventh embodiment of the invention is almost the same as the sixth embodiment except that the connection slots 41 of the plastic base 40 face upwards. The metal housing 90 is composed of a front housing 91 and a rear housing 92. The front housing 91 has one front plate and two side plates. The rear housing 92 has a top plate and a rear plate. The rear housing 92 is formed with four openings 93, which correspond to the four connection slots 41, on the top plate.

Figure 21:
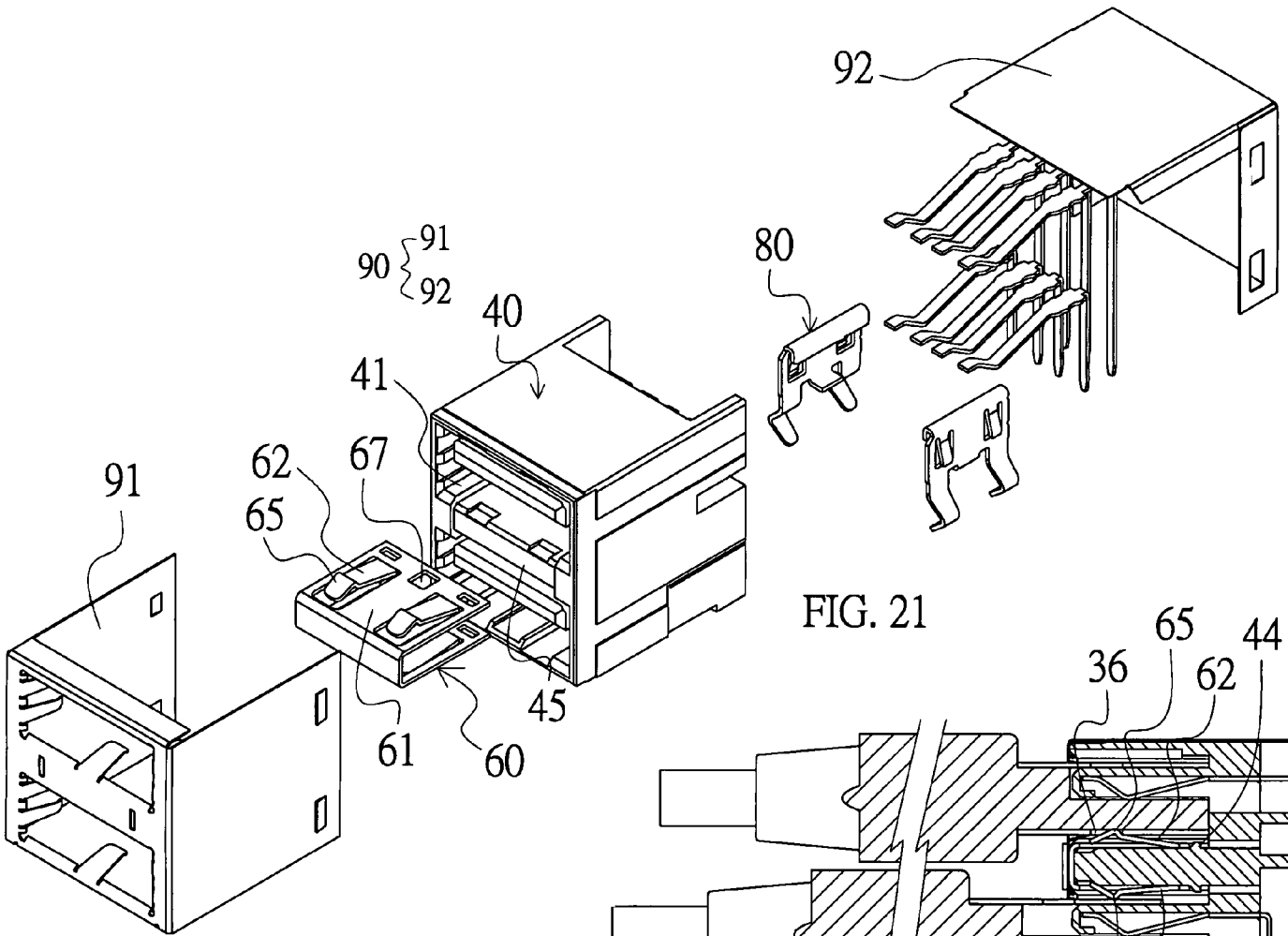
FIG. 21 is a pictorially exploded view showing an electrical connector according to an eighth embodiment of the invention.
Figure 22:
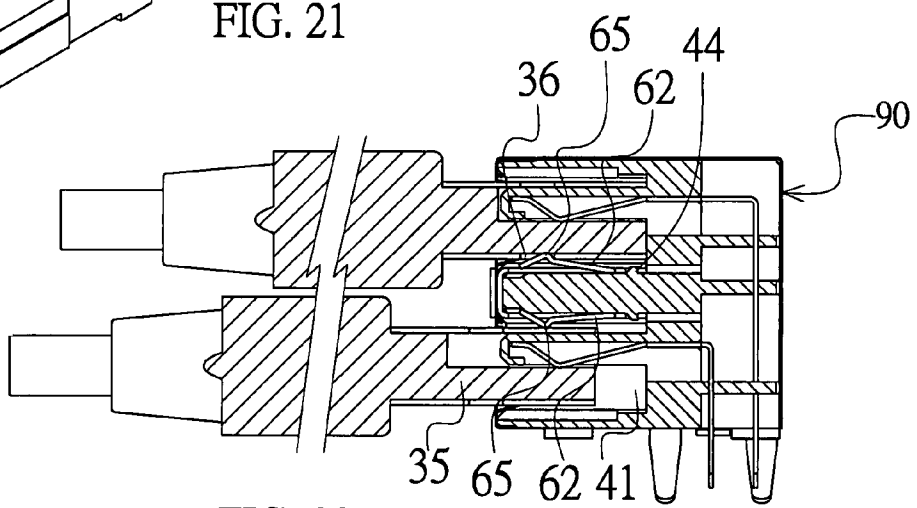
FIG. 22 is a cross-sectional side view showing a usage state of the electrical connector according to the eighth embodiment of the invention.

As shown in FIGS. 21 and 22, the eighth embodiment of the invention is almost the same as the second embodiment except that the engaging element 60 of the eighth embodiment is assembled and fixed in the plastic base 40 form the front end of the plastic base 40. The engaging element 60 has one positioning part 61 and four elastic engaging pieces 62. The positioning part 61 has a ⊏-shaped cross-sectional area, and an upper surface and a lower surface, each of which is formed with an engagement hole 67. The elastic engaging piece 62 is prodded and pressed to project from the upper and lower surfaces of the positioning part 61. A projecting engaging portion 65 for engaging the engagement hole 36 of the USB plug 35 is formed at a portion near a distal end of the elastic engaging piece 62. When the engaging element 60 is assembled, from the front side to the back side, with the baffle 45 of the plastic base 40, the engagement hole 67 may engage with the engaging block 44 in the plastic base 40, and the elastic engaging piece 62 is located in the connection slot 41 of the plastic base, as shown in FIG. 22. When being pressed by the USB plug 35, the elastic engaging piece 62 rests against the baffle 45 to increase its intensity and thus the engaging force so as to prevent the USB plug 35 from being removed easily. The engaging element 60 of this embodiment is made of a stainless steel plate with the thickness of 0.3 mm, which is thicker than the metal housing made of the stainless steel plate with the thickness of 0.1 mm. The engaging element 60 is pressed to rest against the baffle 45 to further enhance the intensity thereof. Of course, if it is unnecessary to adopt the too-great engaging force, the engaging element 60 may also be made of the stainless steel plate with the thickness smaller than 0.3 mm.

Figures 23, 24:
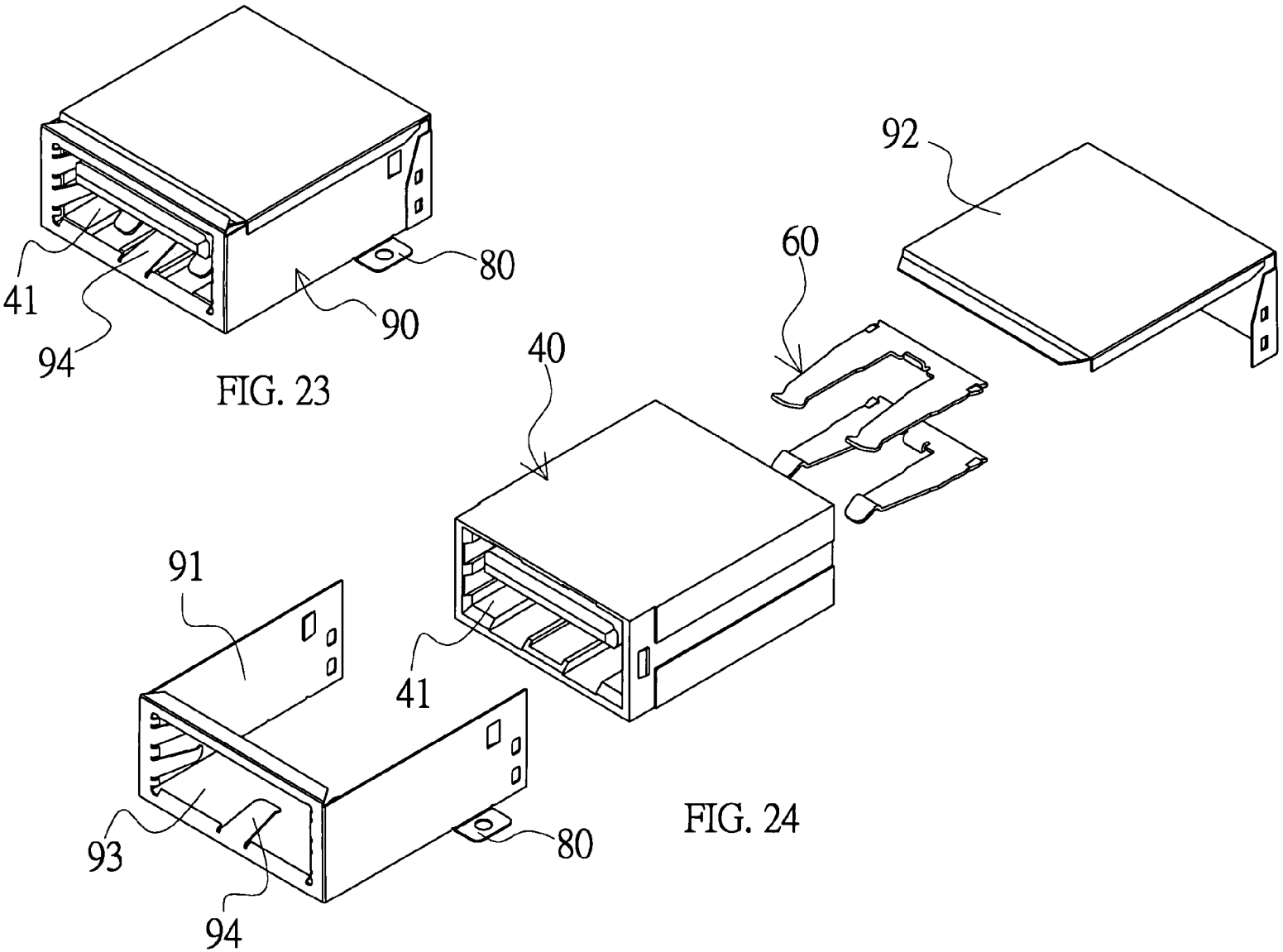
FIG. 23 is a pictorially assembled view showing an electrical connector according to a ninth embodiment of the invention.
FIG. 24 is a pictorially exploded view showing the electrical connector according to the ninth embodiment of the invention.

As shown in FIGS. 23 and 24, the ninth embodiment of the invention is almost the same as the first embodiment except that the connector of the ninth embodiment includes a single layer of USB socket. The plastic base 40 only has a connection slot 41. The front housing 91 of the metal housing 90 is correspondingly formed with a opening 93. The fastening assembly 80 is horizontal and connected to two sides of the front housing 91 of the metal housing 90. Because the single layer USB socket has a small volume, the material and the plating cost that can be saved when the metal housing 90 and the fastening assembly 80 are manufactured separately are also limited. Thus, the fastening assembly 80 and the metal housing 90 may be integrally connected to each other in order to facilitate the manufacturing process.

Figures 25, 26:
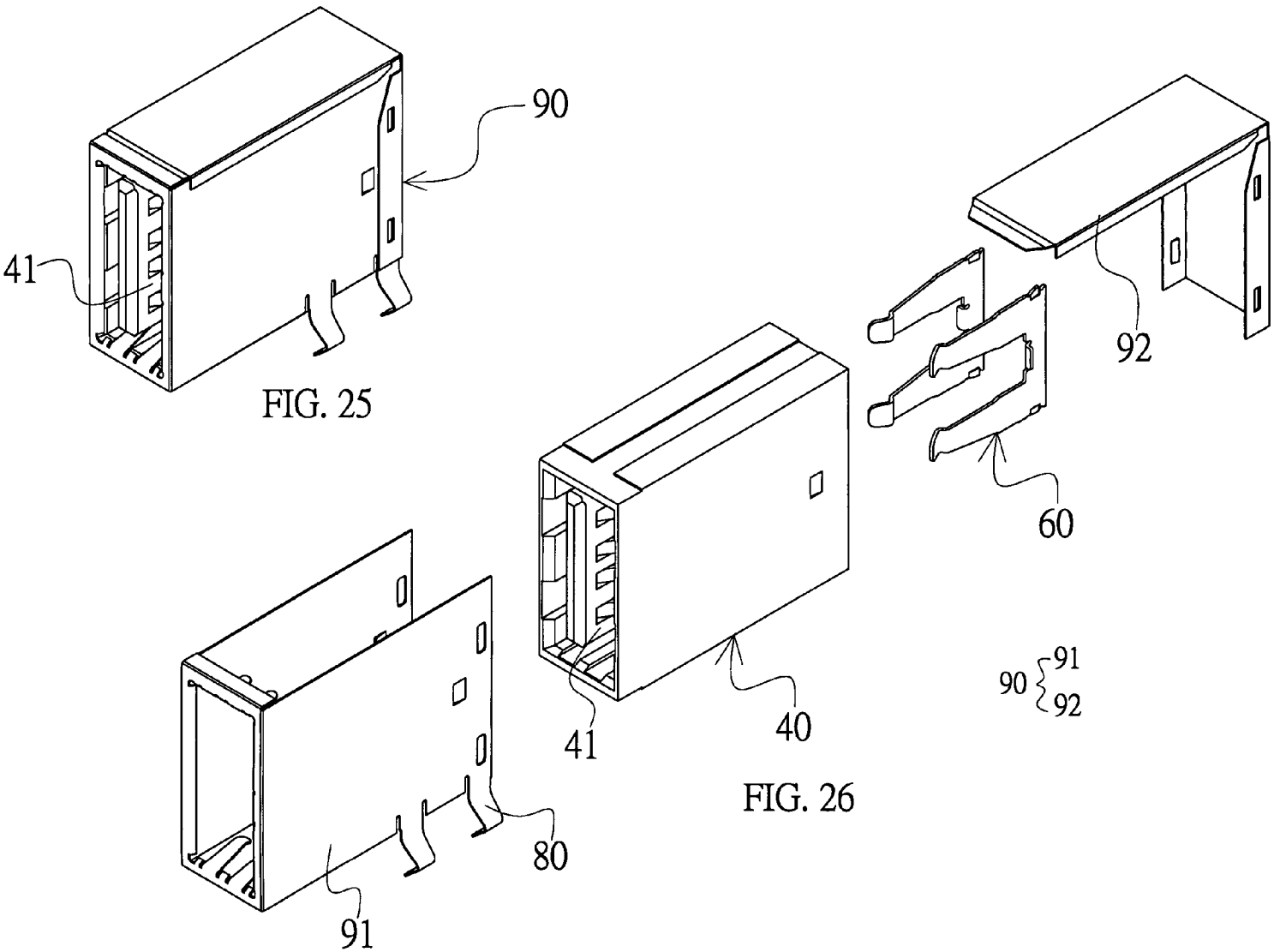
FIG. 25 is a pictorially assembled view showing an electrical connector according to a tenth embodiment of the invention.
FIG. 26 is a pictorially exploded view showing the electrical connector according to the tenth embodiment of the invention.

As shown in FIGS. 25 and 26, the tenth embodiment of the invention is almost the same as the fourth embodiment except that the connection slots 41 of the plastic base 40 of the tenth embodiment are longitudinal, and the fastening assembly 80 is longitudinally and integrally connected to two sides of the front housing 91 of the metal housing 90.

Figures 27, 28:
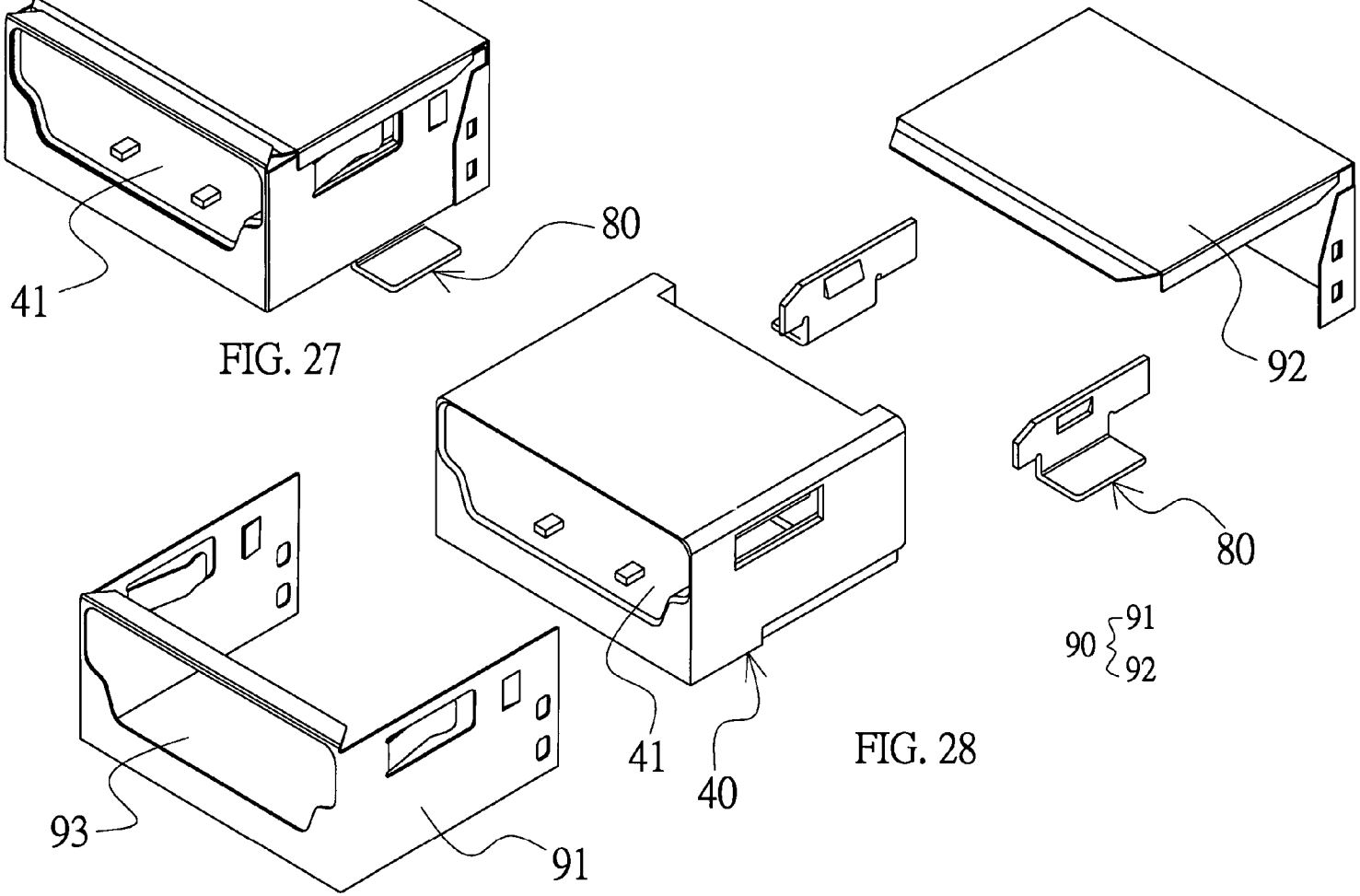
FIG. 27 is a pictorially assembled view showing an electrical connector according to an eleventh embodiment of the invention.
FIG. 28 is a pictorially exploded view showing the electrical connector according to the eleventh embodiment of the invention.

Referring to FIGS. 27 and 28, an audio/video transmission cable socket (e.g., a high definition multimedia interface (HDMI)) according to the eleventh embodiment of the invention includes a plastic base 40, a metal housing 90 and two fastening assemblies 80. The plastic base 40 is formed with a connection slot 41. The metal housing 90 is composed of a front housing 91 and a rear housing 92 that are assembled together. The front housing 91 is formed with an opening 93 through which the connection slot 41 is exposed to the outside. The fastening assemblies 80 are separated from the metal housing before the connector is assembled, positioned at two sides of the plastic base 40 and in contact with the metal housing. The fastening assemblies 80 may be bonded to a circuit board using the surface mount technology (SMT).

Figure 29:
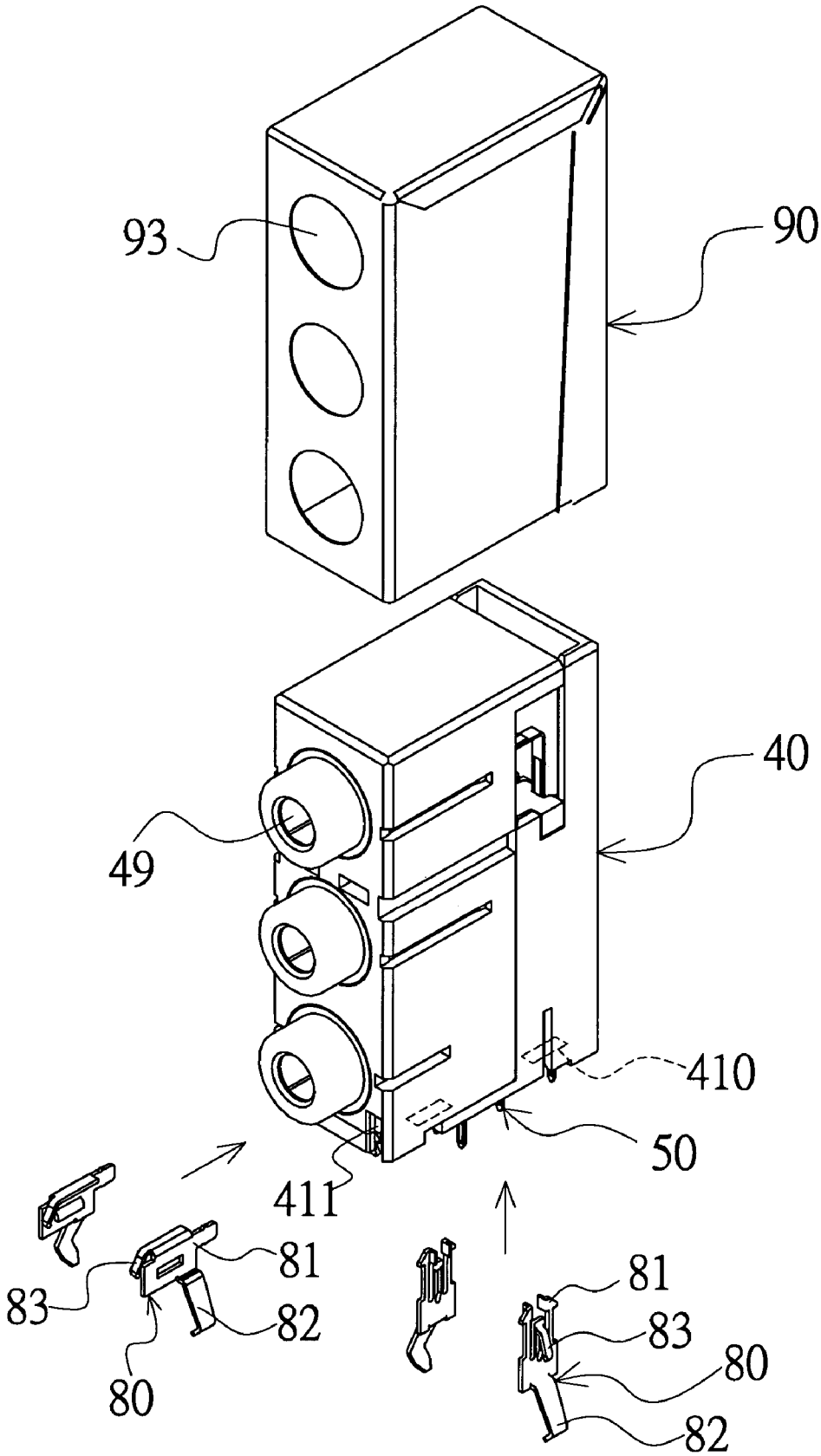
FIG. 29 is a pictorially exploded view showing an electrical connector according to a twelfth embodiment of the invention.

As shown in FIG. 29, the twelfth embodiment of the invention is an electrical connector to be connected to a transmission cable plug of an earphone, a speaker or a microphone. The connector includes a plastic base 40, a metal housing 90 and four fastening assemblies 80. The front end of the plastic base 40 is formed with at least three connection slots 49 disposed vertically, and a plurality of terminals 50. The connection slot 49 is a connection hole. Each terminal has a pin portion extending out of the plastic base 40. The metal housing 90 is formed by bending a stainless steel plate (thin metal plate) having the thickness of 0.1 mm and five faces. The front end of the metal housing 90 is formed with three circular openings 93 and the bottom end of the metal housing 90 is open. The metal housing 90 covers the plastic base 40 while exposing the connection slots 49 of the plastic base and the pin portion of each terminal 50 to the outside. Each of the four fastening assemblies 80 and the metal housing 90 pertain to different elements. The fastening assemblies 80 is made of a stainless steel plate (thick metal plate) with the thickness of 0.3 mm. Each of two fastening assemblies 80 has a fixing part 81, an elastic hook 82 and an elastic sheet 83. The two fastening assemblies 80 are assembled and positioned, from the front side to the back side, in the slots 411 at two sides of the front end of the plastic base through the fixing part 81. Each of the other two fastening assemblies 80 has a fixing part 81, an elastic sheet 83 and the elastic hook 82. The fixing parts 81 of the other two fastening assemblies 80 in the form of symmetrical elastic inverse hooks are inserted, from bottom to top, into the slots 410 of the bottom surface of the plastic base 40. The elastic sheet 83 of each fastening assembly 80 is in elastic contact with the metal housing 90. The elastic hook 82 hooks a hooking hole of a circuit board to form the electrical connection.

Figure 31:
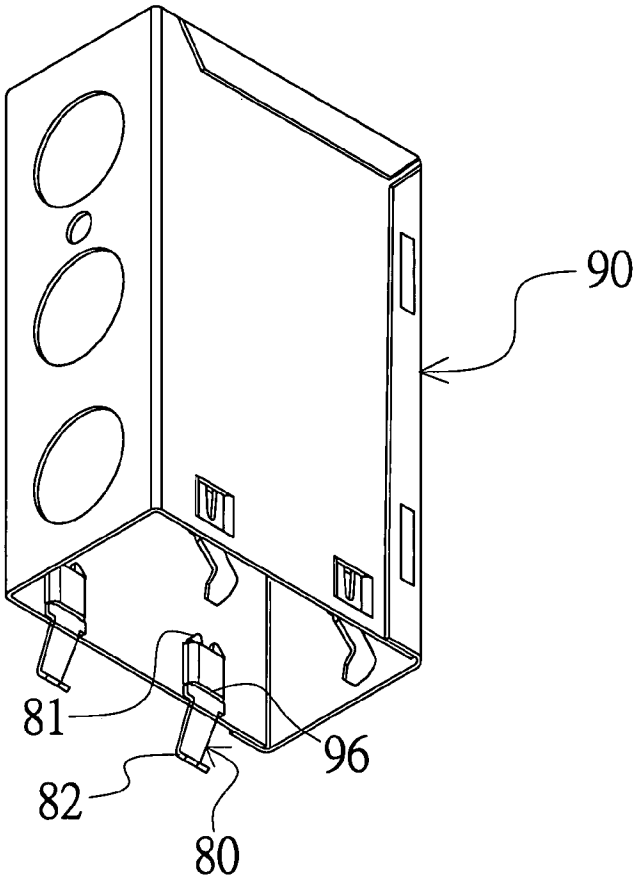
FIG. 31 is a pictorially assembled view showing the metal housing and the fastening assembly in the electrical connector according to the 13th embodiment of the invention.
Figure 30:
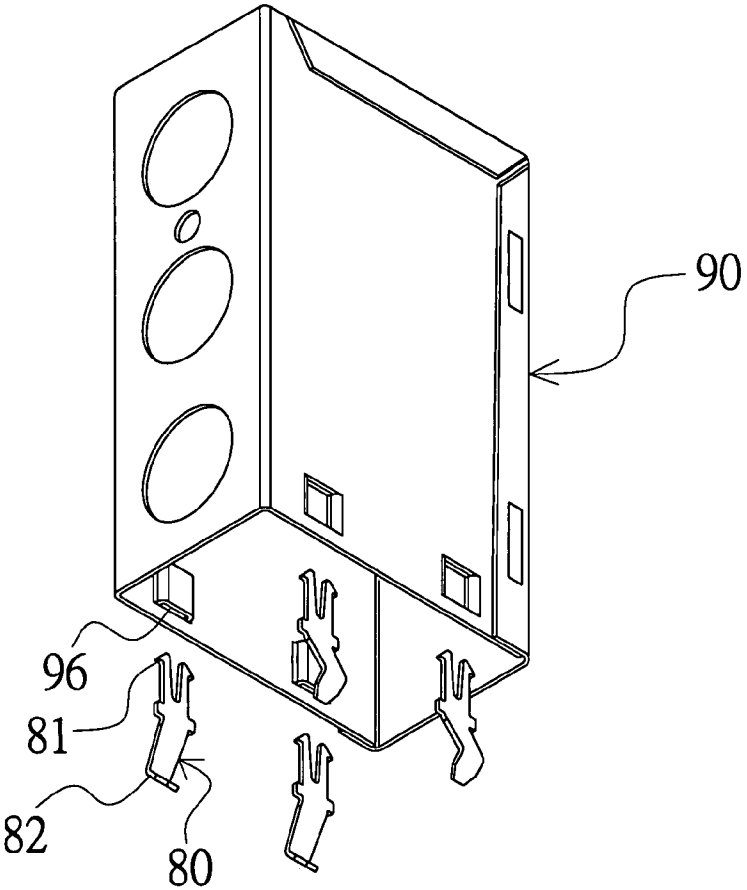
FIG. 30 is a pictorially exploded view showing a metal housing and a fastening assembly in an electrical connector according to a 13th embodiment of the invention.

As shown in FIGS. 30 and 31, the 13th embodiment of the invention is almost the same as the twelfth embodiment except that two slots 96 are formed at a portion near bottom ends of two side plates of the metal housing 90. The top end of the fastening assembly 80 is formed with two fixing parts 81 in the form of two elastic inverse hooks, which is to be inserted into the slots 96 of the metal housing 90 for hooking. The bottom end of the fastening assembly 80 is formed with an elastic hook 82 for hooking a circuit board.

Figure 32:
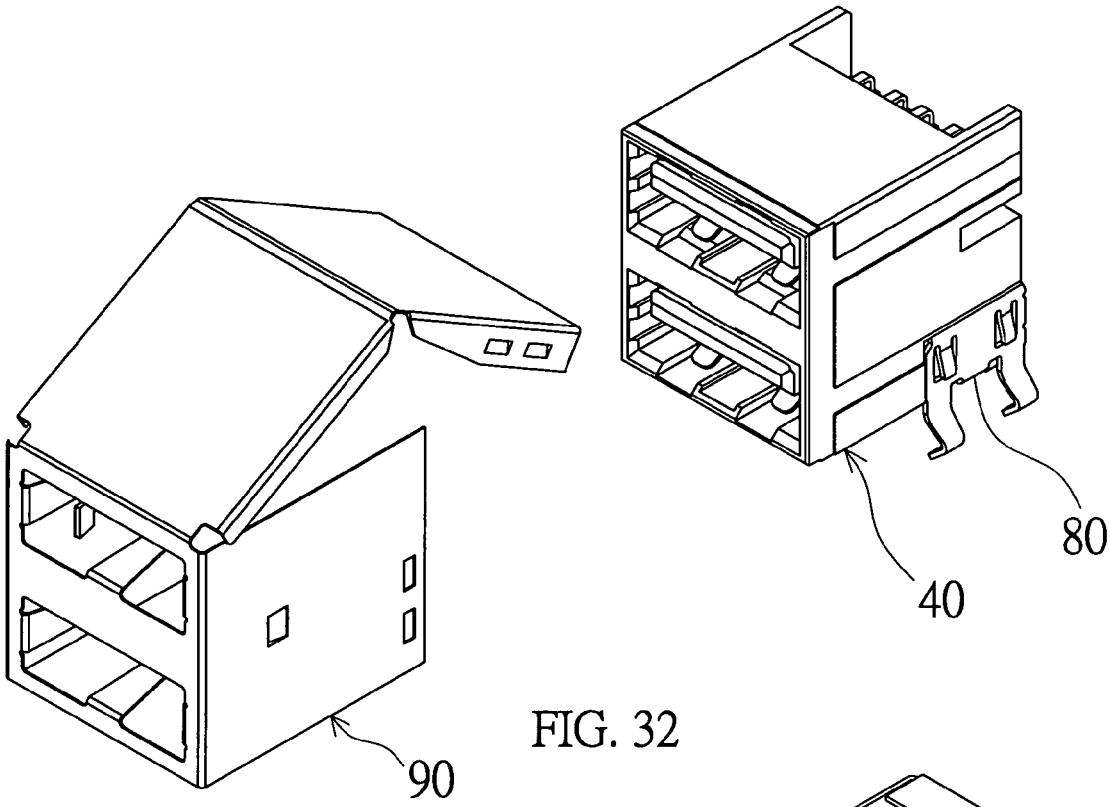
FIG. 32 is a pictorially exploded view showing an electrical connector according to a 14th embodiment of the invention.

As shown in FIG. 32, the 14th embodiment of the invention is almost the same as the first embodiment except that the metal housing 90 of the 14th embodiment is formed by bending five plates that are connected together.

Figure 33:
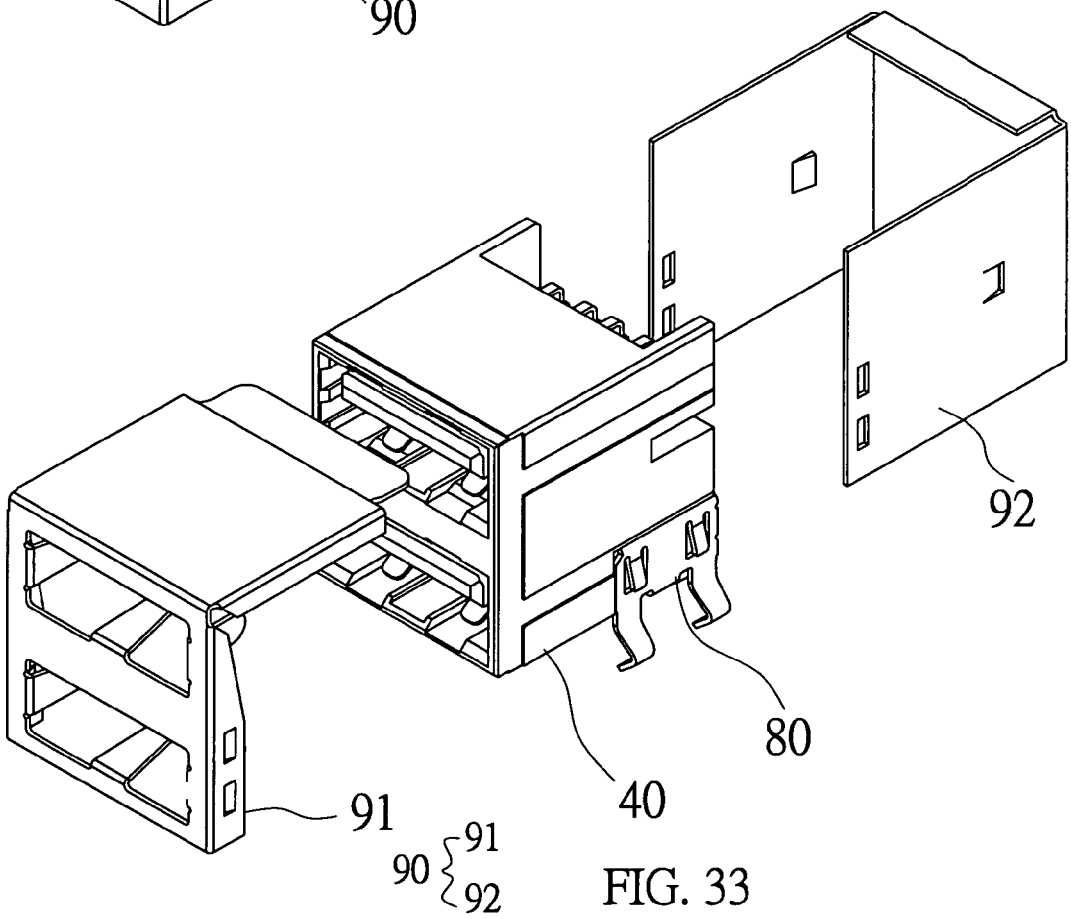
FIG. 33 is a pictorially exploded view showing an electrical connector according to a 15th embodiment of the invention.

As shown in FIG. 33, the 15th embodiment of the invention is almost the same as the first embodiment except that the metal housing 90 of the 15th embodiment includes a front housing 91 and a rear housing 92 that are assembled together. The front housing 91 has a front plate and a top plate, and the rear housing 92 has two side plates and a rear plate.

While the invention has been described by way of examples and in terms of preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An electrical connector to be electrically connected to a transmission cable plug having one engagement hole, the connector comprising:

a plastic base, on which at least one connection slot and a plurality of terminals are formed, wherein each of the terminals has a pin portion extending out of the plastic base;

a metal housing covering the plastic base while exposing the at least one connection slot of the plastic base and the pin portion of each of the terminals; and at least one engaging element having a fixing part and at least one elastic engaging piece which is located within the at least one connection slot of the plastic base, wherein:

a projecting engaging portion, which is near a distal end of the at least one engaging element and engages with the transmission cable plug, is formed;

the metal housing is composed of a thin metal plate which is bent; and the at least one engaging element and the metal housing pertain to different parts, the metal housing never engages with the engagement hole of the transmission cable plug when the transmission cable plug is inserted from an outermost position of the at least one connection slot to an innermost position of the at least one connection slot, and the at least one engaging element is assembled in the plastic base through the fixing part.

2. The electrical connector according to claim 1, wherein a rear end of the at least one connection slot of the plastic base is formed with a positioning slot and a stopping surface, the fixing part of the at least one engaging element is formed with a stopping portion, and the fixing part is assembled and fixed to the positioning slot in a direction from a rear end of the plastic base to the at least one connection slot.

3. The electrical connector according to claim 1, wherein the at least one engaging element is a plate-like engaging element having an inverse-U shape and has the fixing part and two elastic engaging pieces.

4. The electrical connector according to claim 1, wherein the plastic base is formed with at least two connection slots, a baffle is disposed between the at least two connection slots, the fixing part of the at least one engaging element has a ⊏-shape, each of an upper surface and a lower surface of the fixing part is formed with one elastic engaging piece, and the elastic engaging pieces on two surfaces of the fixing part are respectively located at two sides of the baffle.

5. The electrical connector according to claim 4, wherein the elastic engaging pieces on the upper and lower surfaces of the fixing part of the at least one engaging element are pressed by the transmission cable plug to press the baffle.

6. The electrical connector according to claim 1, wherein the plastic base has at least two connection slots, a baffle is disposed between the at least two connection slots, the at least one elastic engaging piece of the at least one engaging element is disposed at two surfaces of the baffle, and the at least one elastic engaging piece presses the baffle when being pressed by the transmission cable plug.

7. The electrical connector according to claim 1, wherein the plastic base is formed with at least two connection slots which are different in structure and connection function.

8. The electrical connector according to claim 1, wherein the transmission cable plug is a universal serial bus plug.

9. The electrical connector according to claim 1, further comprising at least one fastening assembly, wherein the at least one fastening assembly and the metal housing pertain to different parts, and the at least one fastening assembly contacts the metal housing and is thus electrically connected to a circuit board.

10. The electrical connector according to claim 1, wherein the metal housing is pressed to form an elastic grounding piece for contacting the transmission cable plug inserted into the at least one connection slot.

11. The electrical connector according to claim 9, wherein the at least one fastening assembly has at least one elastic hook for hooking the circuit board.

12. The electrical connector according to claim 9, wherein the at least one fastening assembly has a fixing part fixed to the plastic base.

13. The electrical connector according to claim 1, wherein a thickness of the at least one engaging element is greater than that of the metal housing.

* * * * *